US010493508B2

(12) United States Patent
Bassi et al.

(10) Patent No.: US 10,493,508 B2
(45) Date of Patent: Dec. 3, 2019

(54) ENGINEERED WORK ROLL TEXTURING

(71) Applicant: Novelis Inc., Atlanta, GA (US)

(72) Inventors: Corrado Bassi, Valais (CH); Joerg Mathieu, Valais (CH); Susanne Glock, Miege (CH); Daniel Winkler, Bramois (CH)

(73) Assignee: NOVELIS INC., Atlanta, GA (US)

( * ) Notice: Subject to any disclaimer, the term of this patent is extended or adjusted under 35 U.S.C. 154(b) by 303 days.

(21) Appl. No.: 15/292,636

(22) Filed: Oct. 13, 2016

(65) Prior Publication Data

US 2017/0106418 A1 Apr. 20, 2017

Related U.S. Application Data

(60) Provisional application No. 62/241,567, filed on Oct. 14, 2015.

(51) Int. Cl.
*B21B 1/22* (2006.01)
*B21B 27/00* (2006.01)
(Continued)

(52) U.S. Cl.
CPC ..... *B21B 1/227* (2013.01); *B21B 27/005* (2013.01); *B21H 8/005* (2013.01);
(Continued)

(58) Field of Classification Search
CPC . B21B 2001/221; B21B 1/227; B21B 27/005; B44B 5/0009; B44B 5/0047; B31B 50/142; B31B 50/146; B31F 1/07
(Continued)

(56) References Cited

U.S. PATENT DOCUMENTS 3,839,893 A 10/1974 Appel et al.
4,795,681 A * 1/1989 Furukawa ..... B21B 1/227 428/600
(Continued)

FOREIGN PATENT DOCUMENTS

CN 203221418 10/2013
DE 1168377 B 4/1964
(Continued)

OTHER PUBLICATIONS

Canadian Application No. 3,002,060 , "Office Action", dated Jan. 28, 2019, 7 pages.
(Continued)

*Primary Examiner* — Jason L Vaughan
(74) *Attorney, Agent, or Firm* — Kilpatrick Townsend & Stockton LLP

(57) ABSTRACT

Metal work rolls texturized with engineered textures can impart desired impression patterns on metal strips. Engineered textures can be controlled with particularity to achieve desired surface characteristics (e.g., lubricant trapping, coefficient of friction, or surface reflectivity) on work rolls and metal strips, and to allow for impression patterns to be imparted on metal strips during high percentages of reduction of thickness (e.g., greater than about 5% or greater than about 15%, such as around 30%-55%). Engineered textures can be applied by focusing energy beams at specific points of an outer surface of a work roll to impart texture elements on the work roll. In some cases, an engineered texture element that can be used to generate a generally circular impression element can be generally elliptical in shape, having a length that is shorter than its width by a factor dependent on the reduction of thickness percentage.

18 Claims, 16 Drawing Sheets

(51) Int. Cl.
*B21H 8/00* (2006.01)
*B21H 8/02* (2006.01)
*B21B 3/00* (2006.01)

(52) U.S. Cl.
CPC ..... *B21B 2003/001* (2013.01); *B21B 2261/14* (2013.01); *B21B 2265/14* (2013.01); *B21B 2267/10* (2013.01); *B21H 8/02* (2013.01)

(58) Field of Classification Search
USPC ..... 101/22–23, 32; 492/35, 36
See application file for complete search history.

(56) References Cited

U.S. PATENT DOCUMENTS

| | | | | | |
|---|---|---|---|---|---|
| 4,798,772 | A * | 1/1989 | Furukawa | B21B 1/227 | 428/600 |
| 4,806,731 | A * | 2/1989 | Bragard | B21B 27/005 | 219/121.69 |
| 4,841,611 | A * | 6/1989 | Kusaba | B21B 27/005 | 492/30 |
| 4,959,275 | A * | 9/1990 | Iguchi | B21B 27/005 | 428/603 |
| 4,978,583 | A * | 12/1990 | Wakui | B21B 1/227 | 219/121.68 |
| 4,996,113 | A * | 2/1991 | Hector | B21B 1/227 | 219/121.67 |
| 5,025,547 | A | 6/1991 | Sheu et al. | | |
| 5,143,578 | A * | 9/1992 | Luthi | B23K 26/0823 | 156/272.8 |
| 5,236,763 | A * | 8/1993 | Luthi | B23K 26/0823 | 428/156 |
| 5,250,364 | A * | 10/1993 | Hector, Jr. | B21B 1/227 | 428/687 |
| 5,508,119 | A * | 4/1996 | Sheu | B21B 1/227 | 219/121.67 |
| 5,537,851 | A * | 7/1996 | Sheu | B21B 1/227 | 428/687 |
| 5,552,235 | A * | 9/1996 | Bastawros | B21B 1/227 | 427/327 |
| 5,857,373 | A * | 1/1999 | De Mare | B21B 1/227 | 29/895.3 |
| 6,138,490 | A * | 10/2000 | Shannon | B21B 1/227 | 72/252.5 |
| 6,187,455 | B1 * | 2/2001 | Eschauzier | B21B 1/227 | 160/113 |
| 7,699,686 | B2 * | 4/2010 | Hahn | B21B 1/227 | 451/28 |
| 8,444,092 | B2 | 5/2013 | Li et al. | | |
| 2004/0112104 | A1 * | 6/2004 | Scannans | B21B 1/227 | 72/187 |
| 2006/0123867 | A1 | 6/2006 | Ball et al. | | |
| 2010/0255970 | A1 | 10/2010 | Kogetsu et al. | | |
| 2013/0095343 | A1 * | 4/2013 | Arsene | B21B 1/227 | 428/600 |

FOREIGN PATENT DOCUMENTS

| | | | |
|---|---|---|---|
| DE | 3878444 | T2 | 7/1993 |
| JP | 56144829 | | 11/1981 |
| JP | 5711704 | | 1/1982 |
| JP | 62279038 | | 12/1987 |
| JP | 02229601 | | 9/1990 |
| JP | 03114601 | | 5/1991 |
| JP | 03243201 | | 10/1991 |
| JP | 0491802 | | 3/1992 |
| JP | 0557303 | | 3/1993 |
| JP | 0569007 | | 3/1993 |
| JP | 05293503 | | 11/1993 |
| JP | 06315701 | | 11/1994 |
| JP | 07284873 | | 10/1995 |
| JP | 3514116 | | 6/1998 |
| JP | 2000271602 | | 10/2000 |
| JP | 2001047109 | | 2/2001 |
| JP | 2002292411 | | 10/2002 |
| JP | 2009136893 | | 6/2009 |
| JP | 2009160593 | | 7/2009 |
| JP | 2009178734 | | 8/2009 |
| JP | 2011530443 | | 12/2011 |
| WO | 9731783 | A1 | 9/1977 |
| WO | 9507774 | A1 | 3/1995 |

OTHER PUBLICATIONS

Chinese Application No. 201680060226.8 , "Office Action", dated Dec. 19, 2018, 15 pages.
Pankert, R., "Aufrauhen von Arbeitswalzen in Kaltwalzwerken," Stahl und Eisen, Mar. 14, 1990, pp. 55-60 and 174, vol. 110, No. 3, Verlag Stahleisen, Dusseldorf, Germany.
Dolves, J., "Electron beam texturing of rolls," Iron and Steel Engineer, Aug. 1, 1991, pp. 33-38, vol. 68, No. 8, Association of Iron and Steel Engineers, Pittsburgh, Pennsylvania.
Liewald, M., Prof. Dr.-Ing., "Baustein 10: Grundlagen der Tribologie sowie sugehörige Versuchs- und Messeinrichtungen," Umformtechnik, Jan. 7, 2008, Institute for Metal Forming Technology, Stuttgart, Germany, 21 pages.
Hojda, S., et al., "Simulation des Nachwalzens von Aluminiumband für die Automobilindustrie," 31. Aachener Stahlkolloquim: Ideen Form geben, 2016, pp. 293-302, Verlagshaus Mainz GmbH, Aachen, Germany.
International Patent Application No. PCT/US2016/056795, International Search Report and Written Opinion dated Feb. 22, 2017, 12 pages.
PCT/US2016/056795, International Preliminary Report on Patentability, dated Apr. 26, 2018, 9 pages.
Australian Application No. 2016340275 , "First Examination Report", dated Feb. 21, 2019, 4 pages.
Japanese Application No. 2018-519310 , "Office Action", dated Mar. 26, 2019, 6 pages.
Australian Application No. 2016340275 , "Second Examination Report", dated Aug. 1, 2019, 3 pages.
Chinese Application No. 201680060226.8 , "Office Action", dated Aug. 7, 2019, 13 pages.
Korean Application No. 10-2018-7013565 , "Office Action", dated Sep. 2, 2019, 11 pages.

* cited by examiner

ENGINEERED WORK ROLL TEXTURING

CROSS REFERENCE TO RELATED APPLICATION

The present application claims the benefit of U.S. Provisional Application No. 62/241,567 filed Nov. 14, 2015, entitled "ENGINEERED WORK ROLL TEXTURING," which is hereby incorporated by reference in its entirety.

TECHNICAL FIELD

The present disclosure relates to metalworking generally and more specifically to texturizing work rolls for metal rolling.

BACKGROUND

Metal rolling can be used for forming metal strips from stock, such as ingots or thicker metal strips. Metal rolling can involve a metal strip (e.g., aluminum or other metal) passing between a pair of work rolls of a mill stand, which apply pressure to reduce the thickness of the metal strip. In some operations, each work roll can be supported by one or more backup rolls, although no backup rolls are used in some operations.

The texture of the work roll can be an important factor in metal rolling. For example, a closely polished, smooth work roll can have difficulty providing sufficient friction to grip the metal strip, whereas an overly-textured work roll can impart undesirable localized stresses and impressions on the metal strip. In some operations, a metal strip can pass through several mill stands, each progressively reducing the thickness of the metal strip. In some cases, the final mill stand can use textured work rolls that impart impressions on the metal strip. In some cases, to avoid undesired impressions on the metal strip, this final mill stand is limited to providing a reduction of thickness of about 5% or less.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Certain aspects and features of the present disclosure relate to texturizing metal work rolls with high-precision textures (e.g., engineered textures). Work rolls can be texturized using highly-precise techniques, such as focusing energy beams to specific points of an outer surface of a work roll to impart texture elements on the work roll. In some cases, texturizing techniques can include using beams (e.g., laser beams, electron beams, plasma beams, or combinations thereof) to impart textures on the rolling surface of a work roll with a high level of precision or accuracy. In some cases, multiple beams can be combined to produce highly precise textures. High-precision textures can have specifically engineered shapes, patterns, orientations, depths, dimensions, and other parameters. These textures can be known as engineered textures. In some cases, a work roll with engineered textures can be designed to impart desirable impressions on a metal strip during cold rolling.

Certain types of engineered textures can impart desirable impressions on a metal strip when the metal strip is being reduced in thickness by the work roll at greater than about 5% or greater than about 15%, such as at or about 15%-60%, 20%-50%, 30%-50%, 40%-50%, 20%, 30%, 40%, or 50% reduction of thickness. Certain aspects and features of the present disclosure can operate especially effectively within the range of 25% to 55% reduction of thickness. Certain types of engineered textures can impart impressions that control characteristics of the metal strip, such as controlling the amount of lubrication trapping, the coefficient of friction, and/or the surface reflectivity. In some cases, engineered textures can impart impressions on metal strips to improve the destacking ability of the metal strips (e.g., ability to easily separate stacked metal sheets), such as through improved lubrication trapping. In some cases, different impressions can be applied to the top and bottom of a metal strip based on the different, engineered textures present on the rolling surfaces of the top and bottom rolls. In some cases, an engineered texture that can be used to generate a generally circular impression can be generally elliptical in shape, having a length that is shorter than its width.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
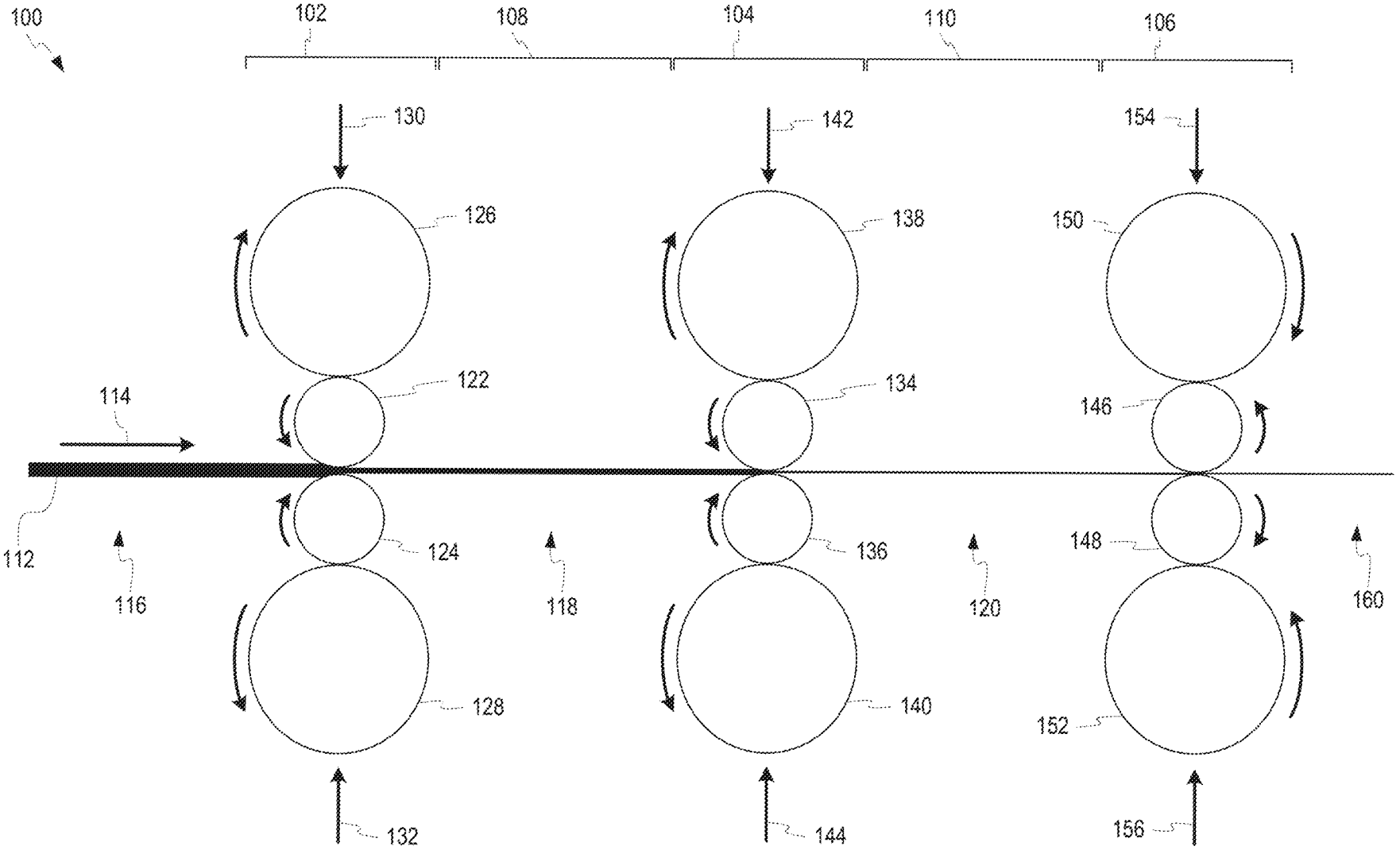
FIG. 1 is a schematic side view of a four-high, three-stand tandem rolling mill according to certain aspects of the present disclosure.

Certain aspects and features of the present disclosure relate to texturizing metal work rolls with engineered textures. Work rolls can be texturized using various techniques, such as electrodischarge texturizing (EDT). In some cases, work rolls can be texturized using highly-precise texturizing techniques, such as focusing energy beams to specific points of an outer surface of a work roll to impart texture elements on the work roll. Such highly-precise texturizing techniques can include using beams (e.g., laser beams, electron beams, plasma beams, or combinations thereof) to impart textures on the rolling surface of a work roll with a high level of precision or accuracy. In some cases, multiple beams can be combined to produce highly precise textures. These high-precision textures can be engineered to have specific shapes, positions, orientations, depths, dimensions, and other parameters. These high-precision textures can be known as engineered textures. Engineered textures can have elements that are non-random in shape, position, orientation, depth, dimensions, or other parameters.

In some cases, a work roll with engineered textures can be designed to impart desirable impressions on a metal strip during cold rolling. Certain types of engineered textures can impart desirable impressions on a metal strip when the metal strip is being reduced in thickness by the work roll at greater than about 5% or greater than about 15%, such as at or about 15%-60%, 20%-50%, 30%-50%, 40%-50%, 20%, 30%, 40%, 50%, or 55% reduction of thickness. Certain aspects and features of the present disclosure can operate especially effectively within the range of 25% to 55% reduction of thickness. Certain types of engineered textures can impart impressions that control characteristics of the metal strip, such as controlling the amount of lubrication trapping (e.g., lubrication retention), the coefficient of friction, the surface reflectivity, the paint appearance of the surface, the destacking ability, or other surface behavior. Certain types of engineered textures can impart impressions that control the overall drawability of the metal strip. In some cases, different impressions can be applied to the top and bottom of a metal strip based on the different, engineered textures present on the rolling surfaces of the top and bottom rolls. In some cases, an engineered texture that can be used to generate a generally circular or circular impression can be generally elliptical or elliptical in shape, having a length that is shorter than its width.

When a metal strip is rolled using a work roll having textures, several factors, including the percentage of reduction of thickness of the metal strip passing the work rolls and the work roll diameter, dictate the relationship between the shape of the texture on the work roll and the shape of the resultant impression on the metal strip. The width of any texture element (e.g., as measured along the width of the work roll, perpendicular to the rolling direction) can translate to the width (e.g., as measured along the width of the metal strip) of a resultant impression at approximately a factor of 1:1. However, the length of any texture elements (e.g., as measured along the circumference of the work roll) can translate to a resultant impression having a length (e.g., as measured along the rolling direction) that is longer than the length of the texture element by an expansion factor (e.g., by geometrical elongation).

For example, at 30% reduction of thickness of the metal strip, the expansion factor can be approximately 2.4, for a roll diameter of approximately 600 mm. Therefore, to produce a circular impression of approximately 70 microns in diameter on a metal strip being reduced in thickness by 30%, the work roll (e.g., approximately 600 mm in diameter) may include an engineered texture element that is elliptical in shape, having a long axis (e.g., major axis) of approximately 70 microns parallel to the width of the work roll and a short axis (e.g., minor axis) of approximately 29.2 microns along the circumference of the work roll. At each of 5%, 10%, 20%, 30%, 40%, and 50% reduction of thickness, the expansion factor can be different for different rolls tailored to each of the respective reduction of thickness. Generally, higher reductions of thickness correspond to higher expansion factors. However, in some cases, a single roll tailored to a single reduction of thickness (e.g., 40%) can be successfully used to produce impressions within acceptable ranges despite being rolled at different reduction of thicknesses (e.g., 30% through 55%). While some examples given herein can be used with work rolls having a diameter of approximately 600 mm, other diameters of work rolls can be used. As the expansion factor increases (e.g., as the percentage of reduction of thickness increases), the length of texture elements on a work roll can impart larger resultant impressions.

In some cases, the length of an impression can be approximated based on Equation 1, where L is the length of the impression, $t_{entry}$ is the time when a particle at the surface of the strip enters the bite between the work rolls, $t_{exit}$ is the time when the same particle exits the bite between the work rolls, $v_R$ is the roll surface speed, and v is the speed of the particle in the bite.

$$L=\max\left(\int_{t_{entry}}^{t_{exit}}(v_R-v(t))dt\right) \quad \text{Equation 1}$$

However, through experimentation and trials, it has been determined that actual length of the impression resulting from engineered textures is generally shorter than the length expected from Equation 1. For example, in certain cases Equation 1 would provide an estimated length increase ratio of approximately 6-7, whereas especially effective results can be achieved with length increase ratios of approximately 1.5 to 4, 2 to 3, or more specifically 2.4 or 2.5. These ratios are surprisingly effective in producing desired impressions, such as round impressions (e.g., with a length to width ratio of 0.8 to 1.2, 0.9 to 1.1, or at or approximately 1), despite Equation 1 predicting the need for larger ratios. In some cases, a desired impression can be generated using a ratio that is between 4 and 10, between 6 and 8, or more specifically at or approximately 7.

Additionally, various factors can affect the surface roughness of the metal strip, including the diameter of the work roll, the amount of cold reduction, the tension difference between the entry side and the exit side of the work rolls (e.g., the tension difference between a decoiler and coiler on opposite sides of the work rolls), and the surface roughness of the work roll. The relationship between the surface roughness of the metal strip and the surface roughness of the work roll can be described as a transfer coefficient. For example, as a work roll becomes smaller, its transfer coefficient moves closer to 1 (e.g., the roughness on the work roll will equal the roughness of the metal strip). In an example (e.g., with EDT texturizing), at 5% cold reduction, using a roll having a diameter approximately around 570-600 mm, the transfer coefficient can be approximately 2 (e.g., the metal strip will have a surface roughness that is half that of the work roll).

In some operations, it can be desirable to use an EDT-texturized work roll during a final pass in a rolling mill. For example, in a multiple-stand mill, the final stand can include EDT-texturized work rolls. Non-engineered textures (e.g., formed without high-precision) can be relatively random in position and shape and various parameters of the texture may not be accurately controllable (e.g., width, length, orientation, depth, shape, positioning, or overlapping). Typical rolling mills may otherwise by capable of sustaining finishing passes with a reduction of thickness of greater than 5%, 10%, 15%, 20%, 30%, 40%, 50%, or 55%, or any ranges therebetween. However, the use of a work roll with non-engineered textures may significantly limit the reduction of thickness available during this finishing pass. When non-engineered textures are used on work rolls and the metal strip is rolled at certain percentages of thickness reduction (e.g., greater than 5% or greater than 15%), excessively long impressions (e.g., channels) can be imparted onto the metal strip, which can detrimentally affect the characteristics of the metal strip (e.g., non-homogeneous friction behavior or paint appearance issues), potentially resulting in the need to scrap the metal strip (e.g., due to non-homogenous friction behavior or paint appearance issues).

To reduce the chance of undesirable impressions on the metal strip when rolling using a work roll having non-engineered textures, the percentage of reduction of thickness during the final pass may be limited. For example, in producing textured auto sheet, the final pass may be limited to 5% reduction of thickness. In an example, a coil of aluminum starting at 9.5 mm can undergo a first reduction to 5 mm (e.g., approximately 47% reduction), a second reduction to 1.8 mm (approximately 64% reduction), a third reduction to 1.05 mm (e.g., approximately 42% reduction), and a final reduction (e.g., with a non-engineered EDT-texturized work roll) to 1 mm (e.g., approximately 5% reduction). If that work roll with non-engineered textures were used to reduce the thickness of a metal strip at higher percentages (e.g., higher than 5%), the resultant impressions may include long channels, which can detrimentally affect the characteristics of the metal strip, potentially resulting in the need to scrap the metal strip.

A work roll having engineered textures can be designed so that the texture elements impart desired impressions upon rolling at a particular percentage reduction of thickness. Impression parameters, such as shape, length, width, depth, positioning, and orientation, and other parameters can be controlled by determining the corresponding engineered texture element necessary to produce the desired impression at a desired percentage reduction of thickness.

In an example, at reductions of thickness higher than 5% (e.g., 30% up to 55%), work rolls with an engineered texture with positive skew (e.g., extending radially outwards, away from the nominal surface of the work roll) having a generally elliptical shape with a long axis parallel to the width of the work roll and a short axis parallel to the direction of rolling can impart a generally circular impression with a negative skew (e.g., in intaglio, extending below the nominal surface of the metal strip).

Work rolls with engineered textures can enable a mill to operate more efficiently. For example, a mill producing textured auto sheet using work rolls with engineered textures can operate with fewer mill stands because the final reduction can be performed at a higher possible percentage reduction of thickness. In an example, a coil of aluminum starting at 9.5 mm can undergo a first reduction to 4 mm (e.g., approximately 58% reduction of thickness), a second reduction to 1.4 mm (e.g., approximately 65% reduction of thickness), and a final reduction (e.g., with a work roll having engineered textures) to 1 mm (e.g., approximately 29% reduction of thickness). Decreasing the number of passes and number of stands can result in substantial cost and time savings, among other savings. In the example, the ability to roll the final product in three passes, instead of four passes, can allow the mill to produce 20-30% more product in a given day.

In some cases, engineered textures are textures that contain elements of specific shapes, sizes, and/or positions that are designed to achieve certain characteristics in the work roll (e.g., increased roughness) or are designed to impart certain specific impressions in a metal strip rolled by the work roll. The specific impressions resulting in certain properties of the metal strip can be generally circular in shape or of another desired shape. The specific impressions can have lengths (e.g., diameters or other dimensions) of approximately 25-150 microns, approximately 50-100 microns, approximately 150 microns or smaller, approximately 100 microns or smaller, or approximately 50 microns or smaller. In some cases, engineered textures contain elements that are shaped and oriented to produce impressions with generally circular elements on a metal strip rolled by the work roll at approximately 5% or greater, 10% or greater, 15% or greater, 20% or greater, 25% or greater, 30% or greater, 35% or greater, 40% or greater, or 45% or greater, or 50% or greater reduction of thickness, including at or about 15%-60%, 20%-50%, 30%-50%, 40%-50%, 20%, 30%, 40%, or 50% reduction of thickness. In an example, such an engineered texture element can be an elliptical shape having a long axis parallel the width of the work roll. In some cases, the engineered textures can include elements placed to create a random or pseudo-random pattern (e.g., a stochastic distribution) designed to eliminate undesirable repeating patterns (e.g., moiré patterns appearing after painting).

In some cases, an engineered texture can be created to work well with reductions of thickness of approximately 45%. It has been surprisingly found that these same textures designed for reductions of thickness of 45% can be successfully used with reductions of thickness of approximately 30%, 35%, 40%, 50%, and 55% and still provide desirable results. In some cases, desirable results can be achieved for reductions of thicknesses below 30% and above 55%. In an example, engineered textures with ellipses designed to produce circular impressions in a metal strip rolled at 45% reduction of thickness can provide approximately circular impressions (e.g., having length to width ratios of 0.8 to 1.2 or 0.9 to 1.2) when rolled at a reduction of thickness between 30% and 55%, 35% and 50%, or 40% and 50%. Therefore, in some cases, a single work roll can be used and re-used for various operations with reductions of thickness anywhere between 30% and 55%. This ability to widely use rolls and re-use rolls enables savings in money (e.g., by eliminating the cost to produce extra engineered texturized rolls), time (e.g., by eliminating time to produce extra engineered texture rolls or time to switch out rolls), storage (e.g., by eliminating storage space for multiple extra rolls), as well as other savings.

Engineered textures on a work roll and the impressions they impart on a metal strip can each include many individual elements. Each element can be a location having negative skew (e.g., valleys extending into the nominal surface of the work roll or metal strip) or positive skew (e.g., peaks extending out of the nominal surface of the work roll or metal strip). Negative and positive skew elements on a work roll can produce positive and negative skew elements on a metal strip, respectively. The nominal surface can refer to an imaginary surface at a general distance from the center of a roll (e.g., a circumferential surface at a radial distance) or from the center of a metal strip (e.g., a planar surface at a specific distance from the center of the metal strip). The nominal distance can be based on an original distance (e.g., original radius of a work roll before being texturized), an average distance (e.g., average heights of the peaks and valleys, such as in a metal strip), or an expected distance if no texturizing exists (e.g., an expected distance based on if a metal strip were to undergo rolling with a non-texturized work roll).

The combination of one or more element on a surface (e.g., surface of a work roll or surface of a metal strip) can have various effects on the characteristic of that surface. For example, the combination of one or more elements can create a closed volume which can contain lubricant for lubricant trapping purposes. This closed volume can be located between positive skew elements or within negative skew elements. The closed volume can reduce the coefficient of friction of the surface (e.g., lubricated surface). The shape, size, position, orientation, and/or other parameters of the one or more elements can be precisely defined to control the closed volume, thus controlling the lubrication trapping and coefficient of friction of the surface.

In another example, the combination of one or more elements can increase or decrease the roughness of the surface, which can affect the lubrication and/or coefficient of friction of the surface. The shape, size, position, orientation, and/or other parameters of the one or more elements can be precisely defined to control the roughness of the surface, which can affect the lubrication and/or coefficient of friction of the surface.

In another example, the combination of one or more elements can increase or decrease the contact surface (e.g., total surface area presented for contact) of the surface. For example, a texture or impression having many high, positive skew elements with relatively small peaks spaced apart from one another can create a surface with a relatively low contact surface, since an object coming into contact with the surface would likely only contact the peaks of the elements. Control of the contact surface of the texture or impression can change various characteristics of the surface, such as the hold friction at high pressures. The shape, size, position, orientation, or other parameters of the one or more elements can be precisely defined to control the contact surface.

In another example, the combination of one or more elements can have general shapes and skews (e.g., positive or negative) that can affect various characteristics of the surface. Control of these shapes and skews can change various characteristics of the surface. The shape, size, position, orientation, and/or other parameters of the one or more elements can be precisely defined to control the general shapes and skews of the one or more elements.

In an example, control of the elements of an engineered texture to increase the closed volume and increase the surface contact of the surface can lower the friction of the surface (e.g., lubricated surface) and improve the galling limits, such as a higher resistance to galling (e.g., of the metal strip).

In another example, control of the elements of an engineered texture to increase the closed volume and increase the roughness of the surface can improve lubricant trapping, including improving the saturation of closed volumes, and thus lower the friction of the surface and improve the galling limits (e.g., of the metal strip).

The positioning of individual elements can be randomly, pseudo-randomly, or intentionally. Any combination of the size, shape, skew, and positioning of the elements can be controlled to achieve desired characteristics.

Elements, on a work roll or metal strip, can be beneficial for trapping lubricants (e.g., trapping lubricants in a work roll to aid in rolling or trapping lubricants in a metal strip). For example, it can be desirable to produce automotive sheet metal having impressions suitable for trapping lubricants so that lubricant is available when forming parts out of the metal sheet. In some cases, forming may occur at critical or difficult locations where it may be difficult to supply lubrication (e.g., at difficult corners or in internal recesses of a part). In such cases, it can be desirable to use automotive sheet having a sufficient amount of trapped lubricants to lubricate the sheet during forming of those critical or difficult locations. In some cases, trapped lubricants allow for further downstream processing without the need to supply as much additional lubricant during the downstream processing (e.g., hemming or restriking). Through the use of engineered textures, impressions can be designed to precisely control the amount of lubricant trapping on the metal strip, which can reduce the amount of lubricant present downstream (e.g., by reducing the amount of lubricant added in some downstream processes or otherwise controlling how much lubricant is trapped in the metal strip's surface) where too much lubricant can be harmful or deleterious to certain processes, such as painting or bonding.

In some cases, it can be desirable to produce a metal strip that is more susceptible to forming and/or drawability in a first direction than another direction. Engineered textures on a work roll can impart impressions that increase a metal strip's susceptibility to forming and/or drawability along a desired axis or in a desired direction.

In some cases, various engineered textures can be arranged in an organized pattern with a stochastic fluctuation so that no moiré or regularity in geometry can be visible (e.g., with the naked eye or through painting).

In some cases, engineered textures can be designed to provide a more consistent friction with pressure behavior to work rolls and sheets (e.g., through corresponding impressions) over work rolls and sheets not using engineered textures or their corresponding impressions.

In some cases, engineered textures can improve the friction and/or drawability of a metal strip. For example, impressions imparted by engineered textures can allow a metal strip to reach the galling friction limit at higher friction strength (e.g., amount of force necessary before galling occurs) with relatively higher drawbead pressure (e.g., as compared to non-engineered textures). In an example, a sheet of AlMg0.4Si1.2-T4 being drawn at 90° to the rolling direction can have a galling limit of under 16 $N/mm^2$ when non-engineered EDT textures are used on a work roll to impart impressions on the sheet. However, impressions imparted by engineered textures can allow a metal strip to achieve higher galling limits (e.g., at least approximately 16 $N/mm^2$, at least approximately 18 $N/mm^2$, at least approximately 20 $N/mm^2$, or approximately 20-22 $N/mm^2$). Impressions imparted by engineered textures allow for improved friction of the metal strip, and thus improved friction strength in relation to drawbead pressure, as compared to a metal strip rolled using a work roll having non-engineered textures.

Engineered textures can be designed to obtain desired characteristics of a work roll and/or a metal strip rolled with such a work roll. Such characteristics that may be controllable through the use of engineered textures can include resistance to pressure and friction, lubrication retention, friction coefficient, surface reflectivity, and other characteristics.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic side view of a four-high, three-stand tandem rolling mill 100 according to certain aspects of the present disclosure. The mill 100 includes a first stand 102, a second stand 104, and a third stand 106. The first stand 102 and the second stand 104 are separated by a first inter-stand space 108. The second stand 104 and the third stand 106 are separated by a second inter-stand space 110. A strip 112 passes through the first stand 102, the first inter-stand space 108, the second stand 104, the second inter-stand space 110, and the third stand 106 in direction 114. The strip 112 can be a metal strip, such as an aluminum strip.

As the strip 112 passes through the first stand 102, the first stand 102 rolls the strip 112 to a smaller thickness. As the strip 112 passes through the second stand 104, the second stand 104 rolls the strip 112 to an even smaller thickness. As the strip 112 passes through the third stand 106, the third stand 106 rolls the strip 112 to a final thickness and imparts an impression on the metal strip 112. The impression can also be known as a texture. The impression can comprise many individual elements.

The pre-roll portion 116 is the portion of the strip 112 that has not yet passed through the first stand 102. The first inter-roll portion 118 is the portion of the strip 112 that has passed through the first stand 102, but not yet passed through the second stand 104. The second inter-roll portion 120 is the portion of the strip 112 that has passed through the first stand 102 and the second stand 104, but not yet passed through the third stand 106. The post-roll portion 160 is the portion of the strip 112 that has passed through the first stand 102, the second stand 104, and the third stand 106. The pre-roll portion 116 is thicker than the first inter-roll portion 118, which is thicker than the second inter-roll portion 120, which is thicker than the post-roll portion 160. The mill 100 in FIG. 1 depicts the use of three stands, however any suitable number of stands can be used, including more than or fewer than three. In some cases, a single stand can be used.

The first stand 102 of a four-high stand can include opposing work rolls 122, 124 through which the strip 112 passes. Force 130, 132 can be applied to respective work rolls 122, 124, in a direction towards the strip 112, through backup rolls 126, 128, respectively. In the second stand 104, force 142, 144 is similarly applied to respective work rolls 134, 136, in a direction towards the strip 112, through backup rolls 138, 140, respectively. In the third stand 106, force 154, 156 is similarly applied to respective work rolls 146, 148, in a direction towards the strip 112, through backup rolls 150, 152, respectively. The backup rolls provide rigid support to the work rolls. In some cases, force can be applied directly to a work roll, rather than through a backup roll. In some cases, other numbers of rolls, such as work rolls and/or backup rolls, can be used.

Engineered textures can be present on one or more work rolls 122, 124, 134, 136, 146, 148. Engineered textures present on a work roll of a non-final mill stand (e.g., work rolls 122, 124, 134, 136) can impart impressions that aid in further processing or rolling of the metal strip 112 (e.g., better lubricant retention or better coefficient of friction properties). Engineered textures present on a work roll of a final mill stand (e.g., work rolls 146, 148) can impart impressions that improve the characteristics of the final product.

In some cases, the use of engineered textures allows a mill 100 to operate with increased efficiency. In some cases, the final mill stand (e.g., the third stand 106) can operate with a reduction of thickness percentage of at least approximately 5% or greater than approximately 5%, at least approximately 15% or greater than approximately 15%, such as at or about 15%-60%, 20%-50%, 30%-50%, 40%-50%, 20%, 30%, 40%, or 50% reduction of thickness.

In an example, a metal strip 112 can have a thickness of approximately 9.5 mm at the pre-roll portion 116, can be reduced to approximately 4 mm at the first inter-stand portion 118, can be reduced to approximately 1.4 mm at the second inter-stand portion 120, and can be reduced to approximately 1 mm at the post-roll portion 160, all while applying desired impressions to the metal strip 112 as the metal strip 112 passes through the third stand 106. The impressions on the metal strip 112 can be of a desired shape, such as generally circular. Each element of the impressions can have a length (e.g., as measured along the rolling direction 114) that is less than 30, 9, 8, 7, 6, 5, 4, 3 or 2 times the width of the element. In some cases, the engineered texture can be used to reduce a metal strip at 15% or greater reduction of thickness while imparting impression elements each having a length that is between 1-5, 1-10, 1-15, 1-20, 1-25, or 1-30 times the width of the element. Other thicknesses and percentages of reduction of thickness can be used.

In some cases, a reduction of thickness percentage of approximately 5% or smaller can be used, such as to produce very precise impressions in a metal strip. Very precise impressions can be on the order of approximately 50 microns or smaller (e.g., a circular crater having a diameter of approximately 50 microns or less), including 40, 30, 20, or 10 microns or smaller.

Figure 2:
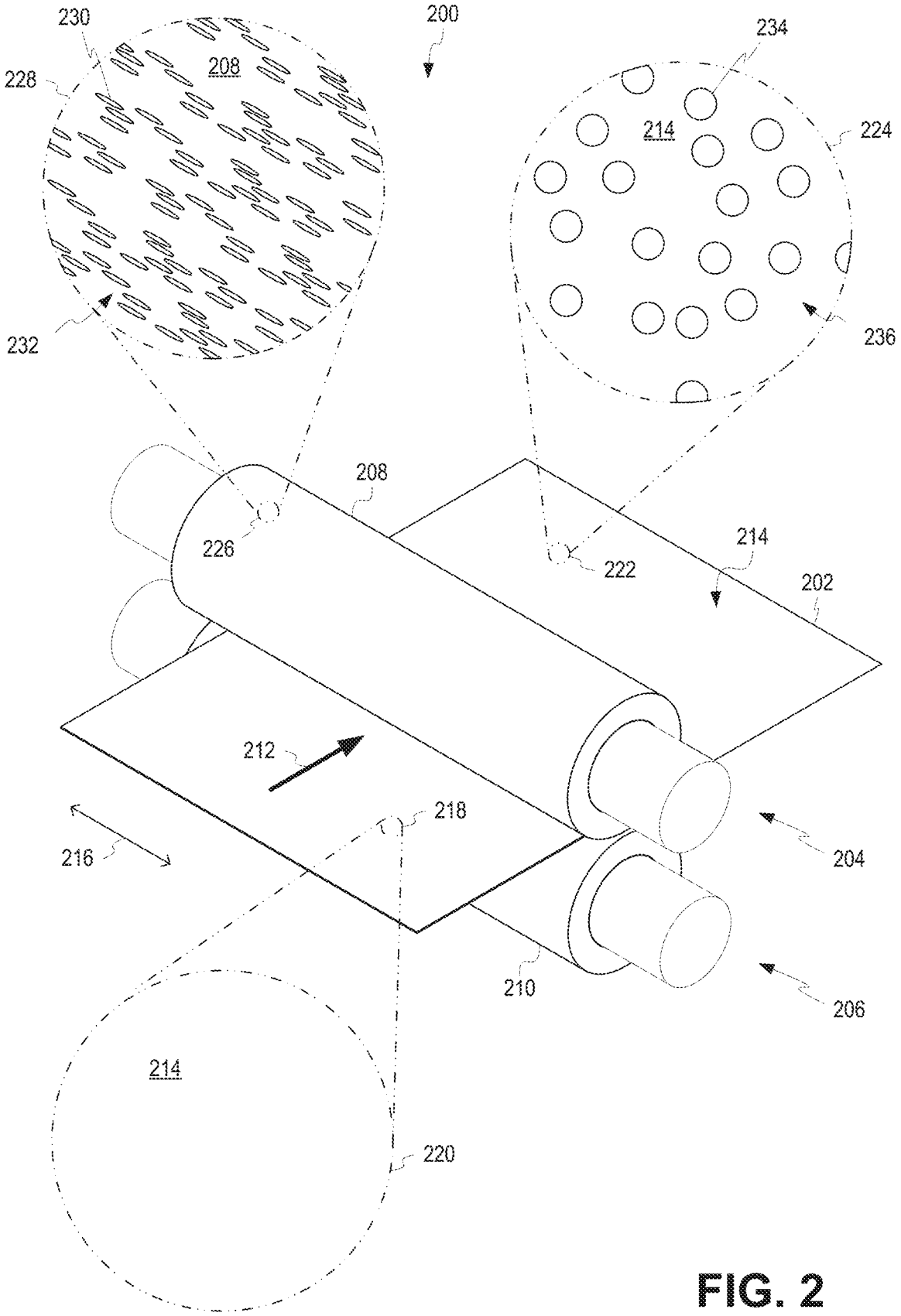
FIG. 2 is an isometric diagram depicting an apparatus for imparting impressions on a metal strip according to certain aspects of the present disclosure.

FIG. 2 is an isometric diagram depicting an apparatus 200 for imparting impressions 236 on a metal strip 202 according to certain aspects of the present disclosure. The apparatus 200 can include a top work roll 204 and a bottom work roll 206. Each work roll 204, 206 can have a respective outer surface 208, 210, which contacts the metal strip 202 during rolling. The metal strip 202 can have a top surface 214 and a bottom surface, which contact the outer surfaces 208, 210 of the work rolls 204, 206, respectively, during rolling. During rolling, the metal strip 202 can pass through the work rolls 204, 206 in direction 212.

Circle 218 indicates a region of the surface 214 of the metal strip 202 before passing through the work rolls 204, 206. Circle 220 depicts a not-to-scale close-up view of the surface 214 at circle 218. The surface 214 can be generally devoid of impressions or can be generally devoid of impressions on the scale of approximately 50 microns to approximately 150 microns.

Circle 226 indicates a region of the surface 208 of the work roll 204. Circle 228 depicts a not-to-scale close-up view of the surface 208 at circle 226. The surface 208 can include an engineered texture 232. The texture 232 can be a number of individual elements 230 positioned randomly, pseudo-randomly, in a particular pattern, or in specific locations. The individual elements 230 can be any suitable shape or size as desired. As seen in FIG. 2, the individual elements 230 are generally elliptical in shape, having a long axis generally parallel to the width of the work roll 204 and a short axis generally parallel to the circumference of the work roll 204.

Circle 222 indicates a region of the surface 214 of the metal strip 202 after passing through the work rolls 204, 206. Circle 224 depicts a not-to-scale close-up view of the surface 214 at circle 222. The surface 214 can include impressions 236 imparted upon the surface 214 by the texture 232 of the work roll 204 during rolling. The impressions 236 can include a number of individual elements 234. The location of the elements 234 of the impressions 236 is based on the position of the elements 230 of the texture 232 as the metal strip 202 passes through the work rolls 204, 206. The width (e.g., as measured across the width of the metal strip in direction 216) of each element 234 can be approximately the same as the width of each element 230 (e.g., the long axis of the generally elliptical shape). The length (e.g., as measured in the rolling direction 212) of each element 234 can be based on the length of each element 230 (e.g., the short axis of the generally elliptical shape) multiplied by an expansion factor that is based on the percentage of reduction of thickness imparted by the work rolls 204, 206, and the roll diameter as described above.

For example, when the percentage of reduction of thickness is approximately 30% and the roll diameter is approximately 600 mm, the expansion factor can be approximately 2.4. While the use of Equation 1 might suggest an expansion factor of approximately seven, it has been determined that an expansion factor of approximately 2.4 may be desirable. Since the length of element 234 is the length of element 230 (e.g., the short axis of the generally elliptical shape) multiplied by 2.4, one can achieve impressions 236 having a generally circular shape by using a work roll 204 having a texture 232 with elements 230 that have widths approximately 2.4 times their length (e.g., the long axis of the generally elliptical shape is 2.4 times the short axis of the generally elliptical shape). Other percentages of reduction of thickness can be used and other desired shapes (e.g., impressions that are not generally circular) can be used.

Figure 3:
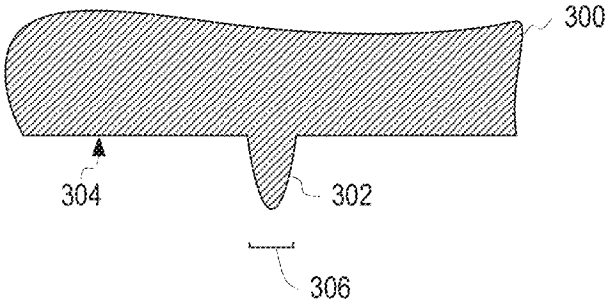
FIG. 3 is a close-up, cross-sectional view depicting a texture element of a work roll according to certain aspects of the present disclosure.

FIG. 3 is a close-up, cross-sectional view depicting a texture element 302 of a work roll 300 according to certain aspects of the present disclosure. The texture element 302 is shown with a positive skew, protruding out of the surface 304 of the work roll 300. The texture element 302 has a length 306.

Figure 4:
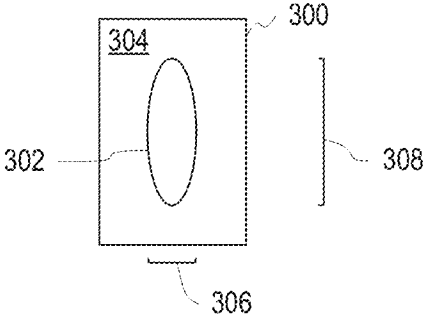
FIG. 4 is a close-up, overhead view depicting the texture element of FIG. 3 according to certain aspects of the present disclosure.

FIG. 4 is a close-up, overhead view depicting the texture element 302 of FIG. 3 according to certain aspects of the present disclosure. The overhead view of FIG. 4 is seen if looking towards the surface 304 of the work roll 300. The texture element 302 is shown as a generally elliptical shape, having a long axis (e.g., width 308) that is approximately 2.4 times longer than its short axis (e.g., length 306).

Figure 5:
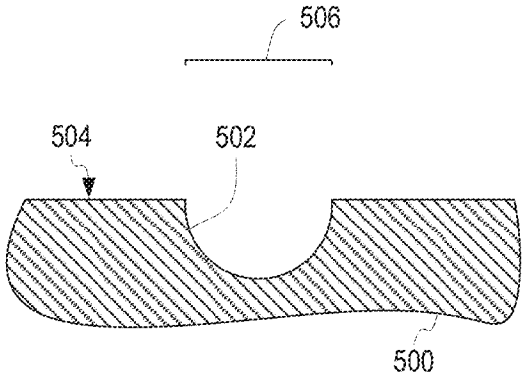
FIG. 5 is a close-up, cross-sectional view depicting an impression element of a metal strip imparted by the work roll of FIG. 3 by rolling at approximately 30% reduction of thickness according to certain aspects of the present disclosure.

FIG. 5 is a close-up, cross-sectional view depicting an impression element 502 of a metal strip 500 imparted by the work roll 300 of FIG. 3 by rolling at approximately 30% reduction of thickness according to certain aspects of the present disclosure. As described herein, the expansion factor at approximately 30% reduction of thickness is approximately 2.4, for a roll diameter of approximately 600 mm. Therefore, the length 506 of the impression element 502 is approximately 2.4 times longer than the length 306 of the texture element 302. Because the texture element 302 has a positive skew, the resultant impression element 502 has a negative skew, protruding into the surface 504 of the metal strip 500.

Figure 6:
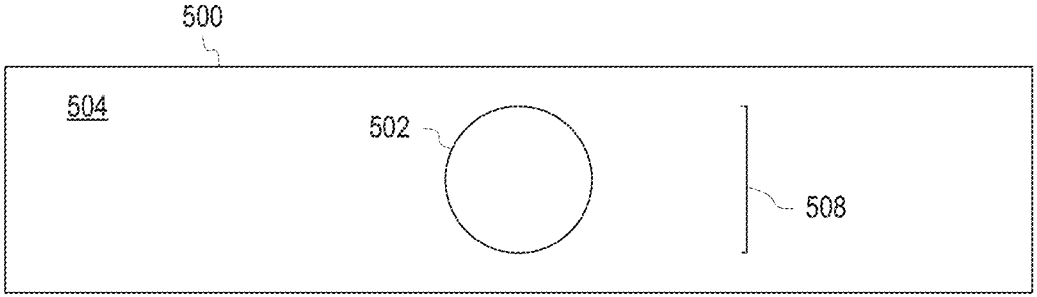
FIG. 6 is a close-up, overhead view depicting the impression element of FIG. 5 according to certain aspects of the present disclosure.

FIG. 6 is a close-up, overhead view depicting the impression element 502 of FIG. 5 according to certain aspects of the present disclosure. The overhead view of FIG. 5 is seen if looking towards the surface 504 of the metal strip 500. The impression element 502 is shown as a generally circular shape. The width 508 of the impression element 502 is approximately equal to the width 308 of the texture element 302.

Figure 7:
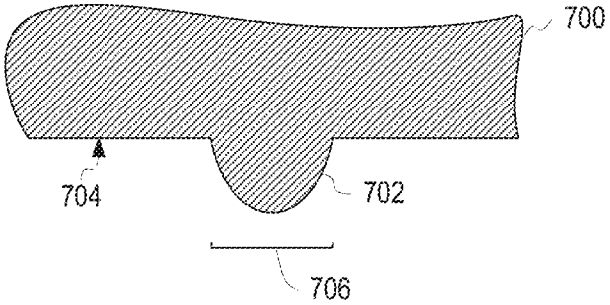
FIG. 7 is a close-up, cross-sectional view depicting a texture element of a work roll according to certain aspects of the present disclosure.

FIG. 7 is a close-up, cross-sectional view depicting a texture element 702 of a work roll 700 according to certain aspects of the present disclosure. The texture element 702 is shown with a positive skew, protruding out of the surface 704 of the work roll 700. The texture element 702 has a length 706.

Figure 8:
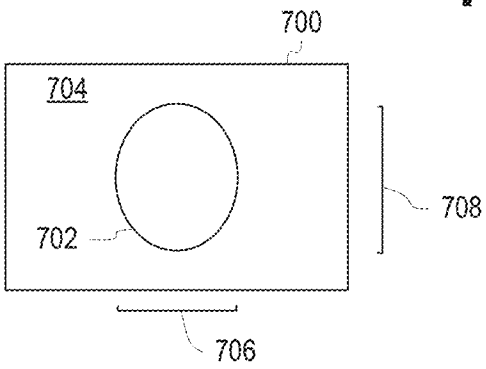
FIG. 8 is a close-up, overhead view depicting the texture element of FIG. 7 according to certain aspects of the present disclosure.

FIG. 8 is a close-up, overhead view depicting the texture element 702 of FIG. 7 according to certain aspects of the present disclosure. The overhead view of FIG. 8 is seen if looking towards the surface 704 of the work roll 700. The texture element 702 is shown as a generally elliptical shape, having a long axis (e.g., width 708) that is approximately 1.2 to 1.3 times longer than its short axis (e.g., length 706).

Figure 9:
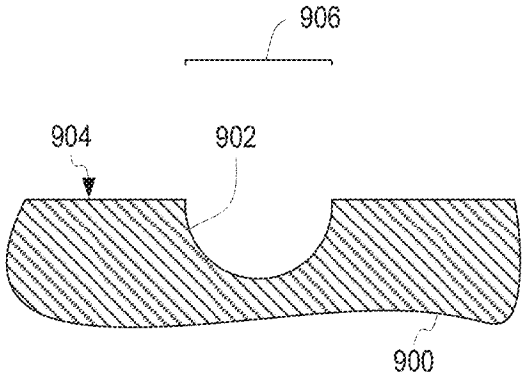
FIG. 9 is a close-up, cross-sectional view depicting an impression element of a metal strip imparted by the work roll of FIG. 7 by rolling at approximately 10% reduction of thickness according to certain aspects of the present disclosure.

FIG. 9 is a close-up, cross-sectional view depicting an impression element 902 of a metal strip 900 imparted by the work roll 700 of FIG. 7 by rolling at approximately 10% reduction of thickness according to certain aspects of the present disclosure. The expansion factor at approximately 10% reduction of thickness can be approximately 1.2 to 1.3, for a roll diameter of approximately 600 mm. Therefore, the length 906 of the impression element 902 can be approximately 1.2 to 1.3 times longer than the length 706 of the texture element 702. Because the texture element 702 has a positive skew, the resultant impression element 902 has a negative skew, protruding into the surface 904 of the metal strip 900.

Figure 10:
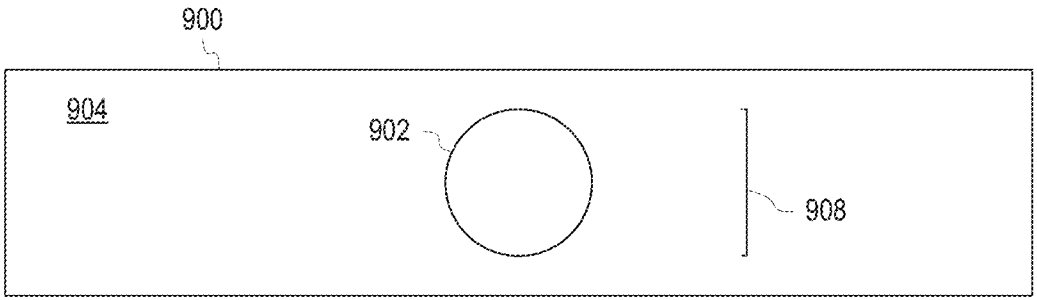
FIG. 10 is a close-up, overhead view depicting the impression element of FIG. 9 according to certain aspects of the present disclosure.

FIG. 10 is a close-up, overhead view depicting the impression element 902 of FIG. 9 according to certain aspects of the present disclosure. The overhead view of FIG. 9 is seen if looking towards the surface 904 of the metal strip 900. The impression element 902 is shown as a generally circular shape. The width 908 of the impression element 902 is approximately equal to the width 708 of the texture element 702.

Figure 11:
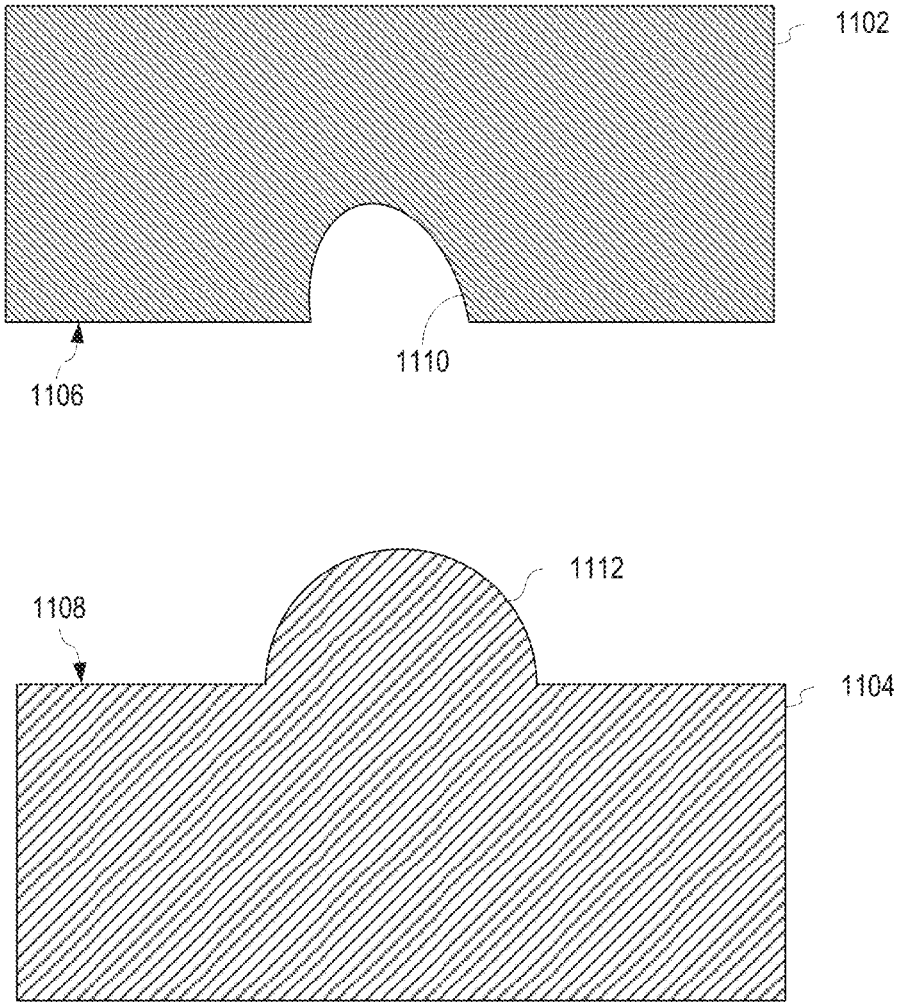
FIG. 11 is a close-up, cross-sectional view depicting an asymmetrical texture element of a work roll adjacent an impression element of a metal strip that was formed by rolling the metal strip with the work roll according to certain aspects of the present disclosure.

FIG. 11 is a close-up, cross-sectional view depicting an asymmetrical texture element 1110 of a work roll 1102 adjacent an impression element 1112 of a metal strip 1104 that was formed by rolling the metal strip 1104 with the work roll 1102 according to certain aspects of the present disclosure. The texture element 1110 has a negative skew, protruding into the surface 1106 of the work roll 1102, which imparts an impression element 1112 having a positive skew (e.g., protruding out of the surface 1108 of the metal strip 1104).

In some cases, the texture element 1110 can be asymmetrical in shape in order to impart a symmetrical impression element 1112 on the metal strip. The asymmetry of the texture element 1110 can be only in the rolling direction (e.g., along the length of the texture element 1110), such that the texture element 1110 appears symmetrical across its width.

All of the texture elements disclosed and depicted herein, including with reference to the other figures, can be made having an asymmetrical shape to impart corresponding symmetrical impression elements.

Figure 12:
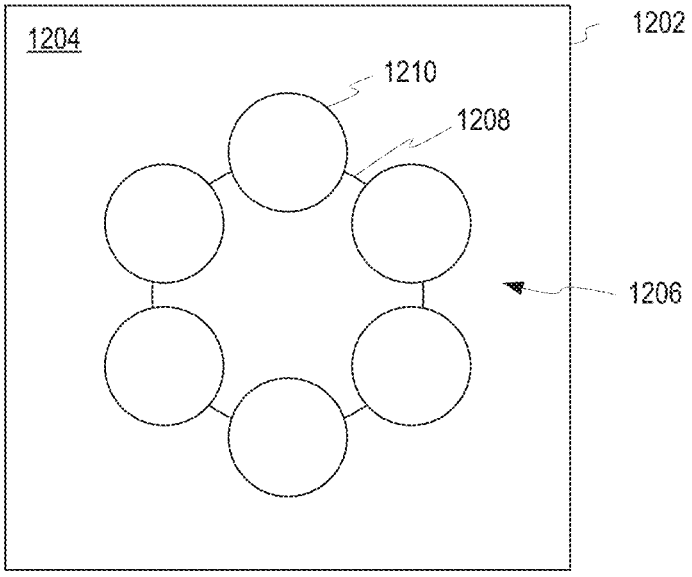
FIG. 12 is a close-up, overhead view of a pattern of impressions on a surface of a metal strip according to certain aspects of the present disclosure.

FIG. 12 is a close-up, overhead view of a pattern 1206 of impressions on a surface 1204 of a metal strip 1202 according to certain aspects of the present disclosure. The use of engineered textures can allow a complex pattern 1206 to be imparted on the metal strip 1202 during rolling. The complex pattern 1206 can include any number of overlapping impression elements, with possibly different depths, in any suitable formation or order.

As seen in FIG. 12, the complex pattern 1206 is an isotropic pattern. The complex pattern 1206 includes a single primary element 1208 surrounded by six smaller, overlapping, secondary elements 1210. Any suitable number of elements (e.g., primary or secondary or other) can be used. The complex pattern 1206 creates a bearing effect because the different size elements can hold different hydrostatic pressures. The complex pattern 1206 can improve the multidirectional friction and load carrying effect of the metal strip 1202.

Other variations of complex patterns can be used, such as non-isotropic patterns. Non-isotropic patterns can be used to increase or decrease certain characteristics of the strip along certain axes or directions.

Figure 13:
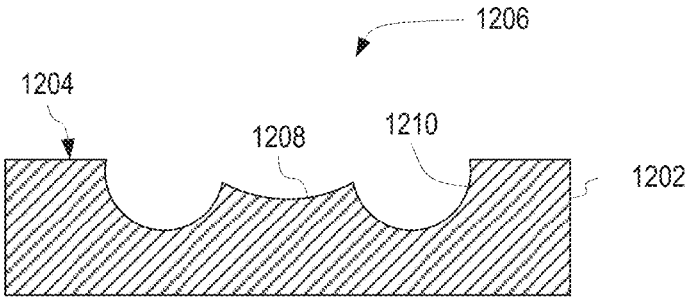
FIG. 13 is a close-up, cross-sectional view depicting the pattern of FIG. 12 according to certain aspects of the present disclosure.

FIG. 13 is a close-up, cross-sectional view depicting the pattern 1206 of FIG. 12 according to certain aspects of the present disclosure. The primary element 1208 is shallower in the surface 1204 of the metal strip 1202 than the secondary elements 1210.

Figure 14:
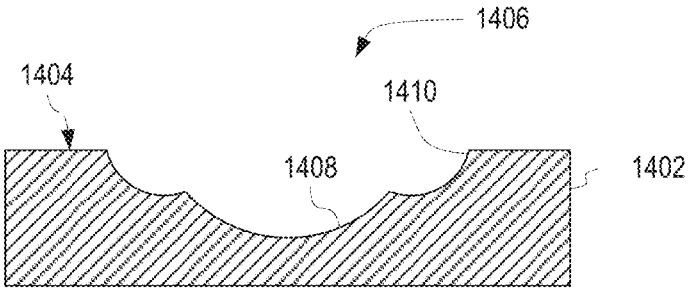
FIG. 14 is a close-up, cross-sectional view depicting a pattern of impressions on a surface of a metal strip according to certain aspects of the present disclosure.

FIG. 14 is a close-up, cross-sectional view depicting a pattern 1406 of impressions on a surface 1404 of a metal strip 1402 according to certain aspects of the present disclosure. The pattern 1406 can be the same as the pattern 1206 of FIGS. 12-13, however the primary element 1408 is deeper in the surface 1404 of the metal strip 1402 than the secondary elements 1410. Other variations can occur with any combination of depths for any of the elements of the complex pattern 1406.

In some cases, the elements of a pattern (e.g., primary element 1408 or secondary elements 1410 of pattern 1406) can have one or more depths specifically engineered for desirable properties. Any suitable depths can be used. In some cases, depths in the range of approximately 0.05 microns to approximately 1 micron may be desirable. In some cases, depths in the rage of approximately 0.05 microns to approximately 2 microns may be desirable. In some cases depths less than 5, 6, or 7 microns may be desirable.

In some cases, a primary element can have a diameter of approximately 50 microns and a first depth. In such cases, secondary elements can have diameters of approximately 100 microns and depths that are collectively or individually greater than, equal to, or less than the first depth. Any combination of the aforementioned primary element and secondary elements may be desirable, including different diameters of the primary and secondary elements.

Precise control of the size, shape, and position of the engineered texture enables complex patterns of impressions on a surface of a metal strip to be precisely controlled, even at reductions of thickness at greater than about 5% or greater than about 15%, such as at or about 15%-60%, 20%-50%, 30%-50%, 40%-50%, 20%, 30%, 40%, or 50% reduction of thickness. Precise control of the complex patterns of impressions can allow for various factors of the metal strip to be controlled, such as a coefficient of friction, a maximum load while maintaining friction (e.g., galling load), and a lubrication retention volume, among others. The following few examples describe possible ways of controlling these factors.

In an example, a complex pattern of impressions can include a central element surrounded by peripheral elements all having a negative skew (e.g., similar to the complex pattern 1206 of FIG. 12). When the engineered texture is designed to result in the peripheral elements being deeper than the central element, the metal strip may have a relatively higher coefficient of friction, a relatively higher galling load, and a relatively lower lubrication retention volume. Conversely, if the engineered texture were designed to result in the peripheral elements being shallower than the central element, the metal strip may have a relatively lower coefficient of friction, a relatively lower galling load, and a relatively higher lubrication retention volume.

In an example, a complex pattern of impressions can include a central element surrounded by peripheral elements all having a positive skew. When the engineered texture is designed to result in the peripheral elements being taller than the central element, the metal strip may have a relatively lower coefficient of friction, a relatively higher galling load, and a relatively lower lubrication retention volume. Conversely, if the engineered texture were designed to result in the peripheral elements being shorter than the central element, the metal strip may have a relatively higher coefficient of friction, a relatively lower galling load, and a relatively higher lubrication retention volume.

In an example, a complex pattern of impressions can include a central element surrounded by peripheral elements. Each element can have a positive or negative skew. When the engineered texture is designed to result in the peaks between the elements having relatively smaller diameters, the metal strip may have a relatively lower coefficient of friction, a relatively higher galling load, and a relatively lower lubrication retention volume. Conversely, if the engineered texture were designed to result in the peaks between the elements having relatively larger diameters, the metal strip may have a relatively higher coefficient of friction, a relatively lower galling load, and a relatively higher lubrication retention volume.

In these examples, the impressions may be controlled in other ways (e.g., adjusting the diameters of the elements, overlap of the elements, skew of elements, width of peaks or plateaus between elements, diameter of peaks between elements, edge shape between elements, among others) to further adjust factors of the metal strip. For example, increasing the depth of an element may increase the lubrication retention volume. In some cases, it may be desirable for portions of a metal sheet to have different properties (e.g., coefficient of friction or galling limit) than other portions of the metal sheet, as described in further detail herein.

Figure 15:
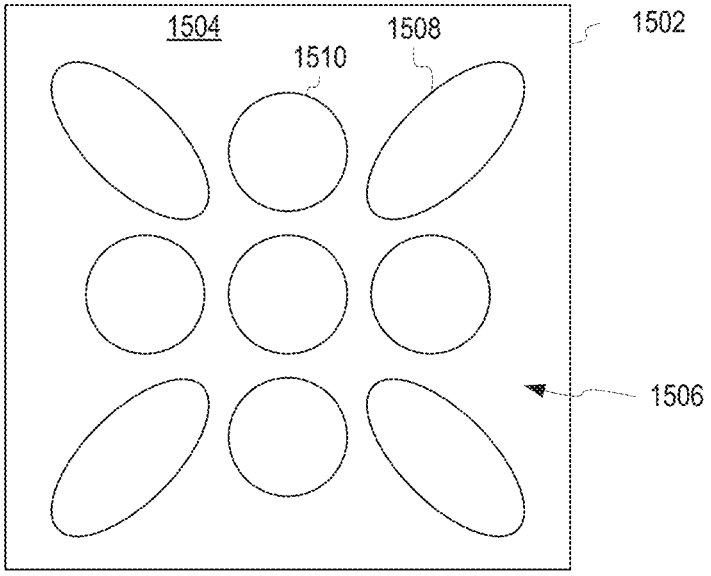
FIG. 15 is a close-up, overhead view of a pattern of impressions on a surface of a metal strip according to certain aspects of the present disclosure.

FIG. 15 is a close-up, overhead view of a pattern 1506 of impressions on a surface 1504 of a metal strip 1502 according to certain aspects of the present disclosure. The use of engineered textures can allow a complex pattern 1506 to be imparted on the metal strip 1502 during rolling. The complex pattern 1506 can include any number of impression elements having varying sizes, shapes, and orientations, in any suitable formation or order. For example, suitable patterns can include one or more impression elements forming ring shapes, circular shapes, channels, or ellipses, among others.

As seen in FIG. 15, the complex pattern 1506 includes five circular elements 1510 and four elliptical elements 1508. The circular elements 1510 are arranged in a cross-like shape, while the elliptical elements 1508 are arranged at approximately 45° angles (e.g., the long axes of the elliptical elements 1508 are at approximately 45° angles from the axes of the cross-like shape created by the circular elements 1510 or the rolling direction). In some cases, the use of a complex pattern 1506 having elliptical elements 1508 arranged at approximately 45° angles can increase lubrication trapping and can reduce friction in certain directions (e.g., along the long axes of the elliptical elements 1508). The use of elliptical elements 1508 arranged at approximately 45° angles can compensate for the weak anisotropy coefficient (e.g., Lankford coefficient) of certain metals in the 45° direction (e.g., $r_{45}$). For example, aluminum can have a relatively weak $r_{45}$, which can be compensated for through the use of complex patterns 1506 described herein. The elliptical elements can be arranged at other angles non-parallel and non-perpendicular to the rolling direction. In some cases, the elliptical elements can be arranged at angles of 45° to the rolling direction and/or 90° to the rolling direction. In some cases, the elliptical elements can be oriented at angles between 45° to 90° with respect to a rolling direction.

The metal strips depicted in and disclosed in relation to FIGS. 12-15 can be formed by rolling using a work roll having various engineered textures. The engineered textures can impart the desired complex patterns of impressions on the surface of the metal strips. The engineered textures can have various depths, roughnesses, or other parameters.

Figure 16:
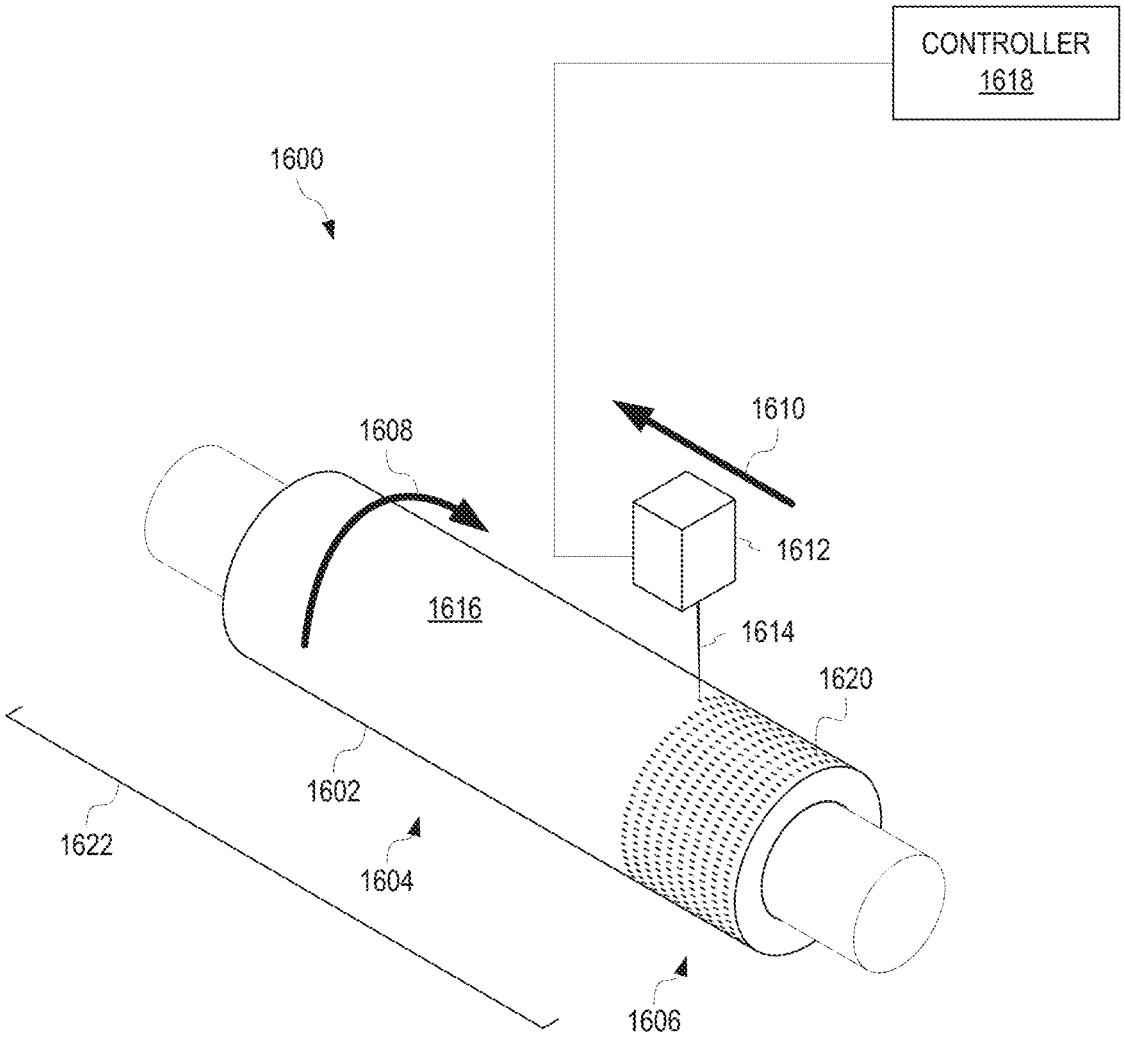
FIG. 16 is an isometric view depicting a system for texturizing a work roll according to certain aspects of the present disclosure.

FIG. 16 is an isometric view depicting a system 1600 for texturizing a work roll 1602 according to certain aspects of the present disclosure. A beam source 1612 can aim a beam 1614 towards the surface 1616 of the work roll 1602. The beam 1614 can form texture elements 1620 on the surface 1616 of the work roll 1602. The work roll 1602 can turn in direction 1608 and the beam source 1612 can move in direction 1610 in order to apply texture elements to any portion of the surface 1616 of the work roll 1602 across the entire width 1622 of the work roll. In some cases, the work roll 1602 moves in direction 1610 and the beam source 1612 rotates in direction 1608. In some cases, the work roll 1602 or the beam source 1612 both rotate in direction 1608 and move in direction 1610. As the texture elements 1620 are applied to the work roll 1602, the work roll 1602 can have a textured portion 1606 and a non-textured portion 1604 (e.g., to be texturized).

In some cases, the beam source 1612 can include one or more mirrors and other optics for rapidly controlling the beam 1614. The location, energy, duration, and movement of a pulse from the beam source 1612 can be controlled, such as with a controller 1618. The controller 1618 can be any suitable processor, circuitry, or electrical device for controlling the beam source 1612. The controller 1618 can also control the movement of the work roll 1602 with respect to the beam source 1612. In some cases, multiple beams 1614 can be used. Multiple beams 1614 can come from a single beam source 1612 or multiple beam sources 1612.

The beam 1614 can be any suitable beam, such as laser, electron, or plasma. Other beam types can be used. Any suitable beam allowing energy to be focused precisely enough to form the desired texture elements on a work roll can be used. In some cases, a beam 1614 can include sparks generated during electrodischarge texturing.

Figure 17:
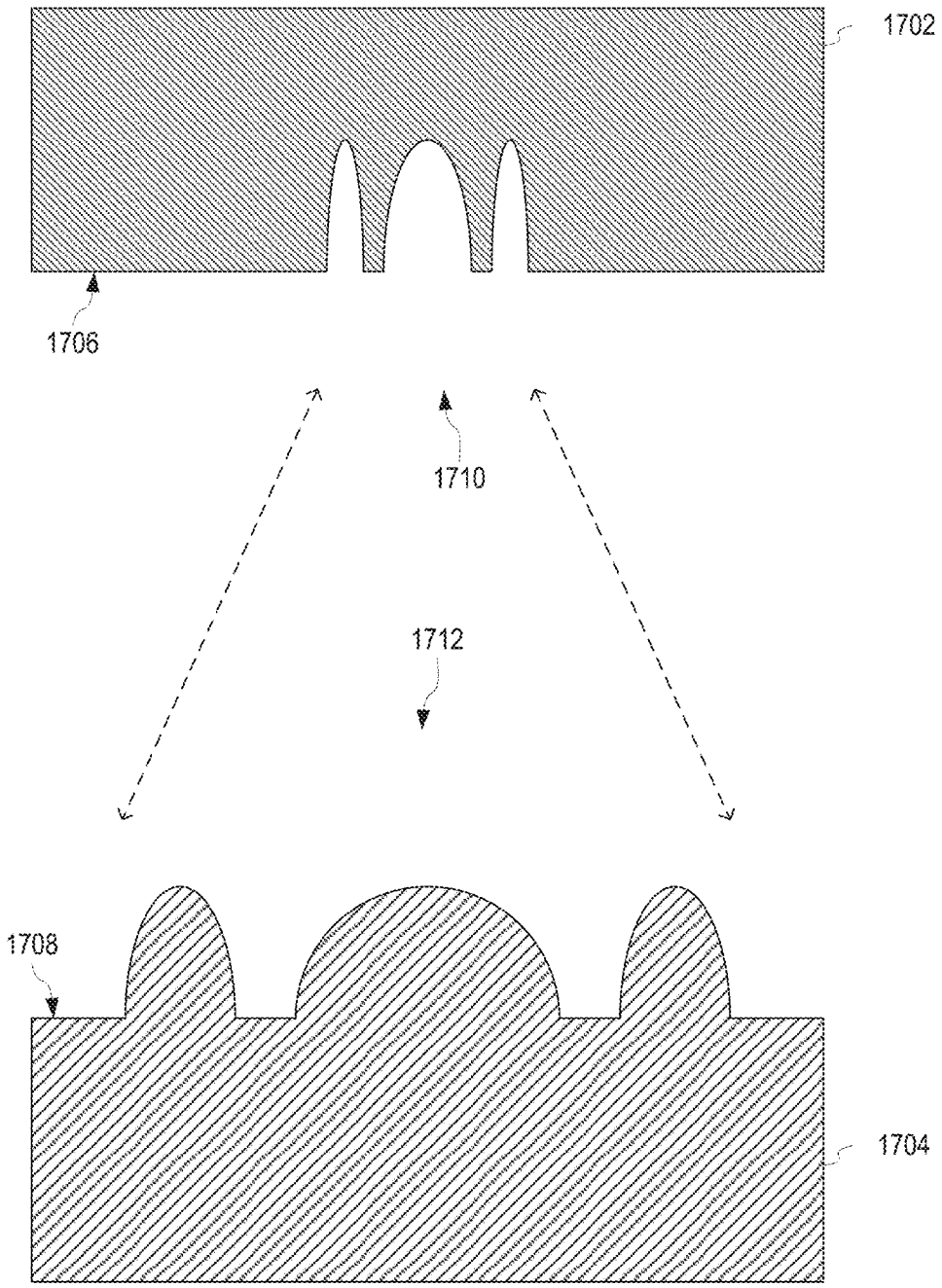
FIG. 17 is a close-up, cross-sectional view depicting a multi-element texture of a work roll adjacent a multi-element impression of a metal strip that was formed by rolling the metal strip with the work roll according to certain aspects of the present disclosure.

FIG. 17 is a close-up, cross-sectional view depicting a multi-element texture 1710 of a work roll 1702 adjacent a multi-element impression 1712 of a metal strip 1704 that was formed by rolling the metal strip 1704 with the work roll 1702 according to certain aspects of the present disclosure. The multi-element texture 1710 has a negative skew, protruding into the surface 1706 of the work roll 1702, which imparts a multi-element impression 1712 having a positive skew (e.g., protruding out of the surface 1708 of the metal strip 1704).

As seen in FIG. 17, the metal strip 1704 has been rolled by the work roll 1702 with a diameter of approximately 600 mm to approximately 30% reduction of thickness. Therefore, the length (e.g., as measured left to right in FIG. 17) of the elements of the impression 1712 are approximately 2.4 times longer than the length of the elements of the texture 1710.

Figure 18:
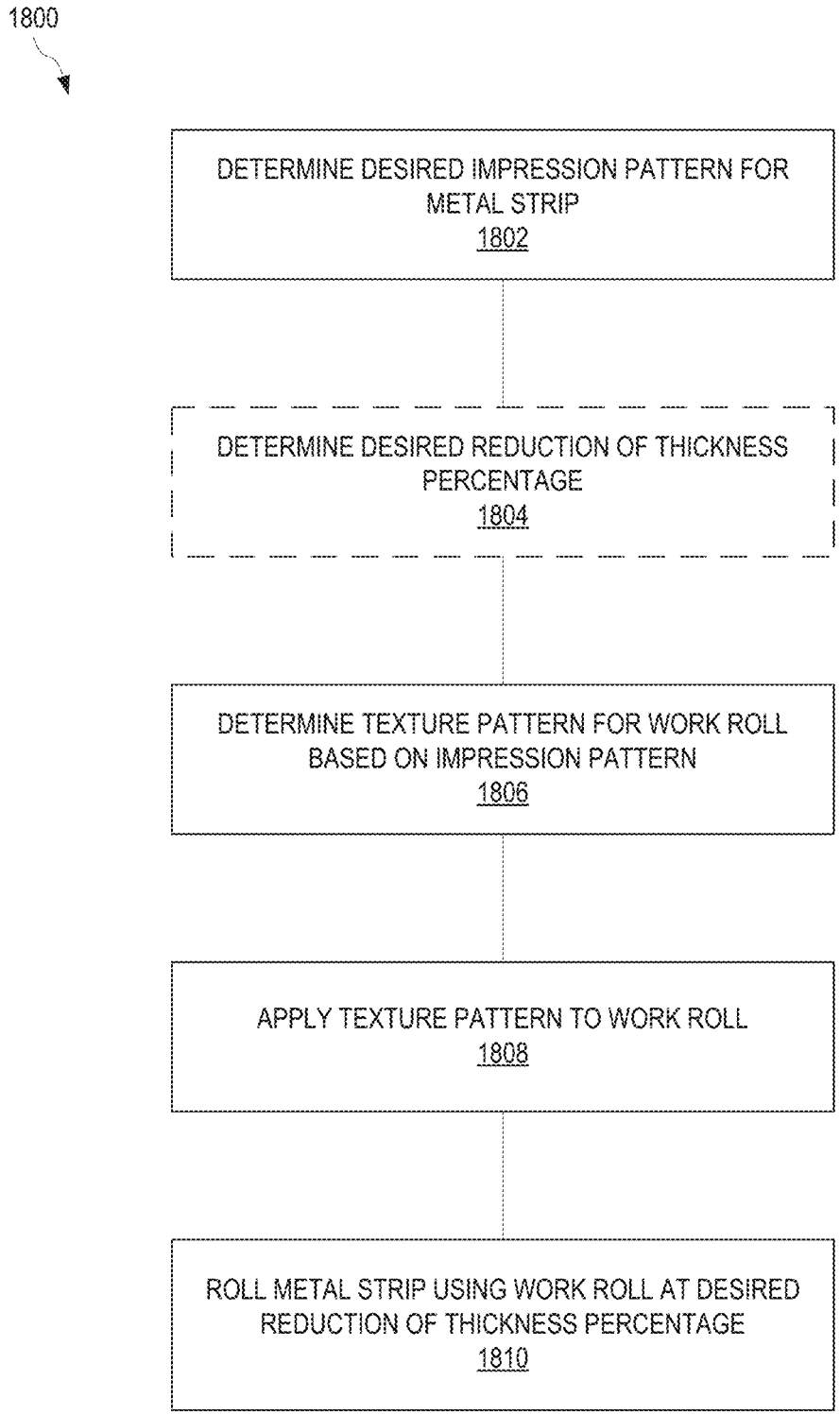
FIG. 18 is a flowchart depicting a method for preparing a work roll with an engineered texture according to certain aspects of the present disclosure.

FIG. 18 is a flowchart depicting a method 1800 for preparing a work roll with an engineered texture according to certain aspects of the present disclosure. At block 1802, a desired impression pattern is determined for a metal strip. As used herein, the term "pattern" can, but does not necessarily, include a repeating pattern. The desired impression pattern can be determined to include any combination of elements, including various shapes, sizes, orientations, positions, and other characteristics of the elements to impart a desired characteristic to the metal strip. For example, a metal strip desired to have increased lubricant trapping can include an impression pattern that has been determined or selected to have high closed volumes, as described herein.

At optional block 1804, a desired reduction of thickness percentage is determined. In some cases, the reduction of thickness percentage can be preset, pre-determined, or determined after determination of a texture pattern at block 1806 (e.g., based on the comparison between the texture pattern and the impression pattern). In some cases, the roll diameter, texture roughness of the roll, and tension differences between the entry and exit of the roll may be determined as well.

At block 1806, a texture pattern for the work roll is determined based on the desired impression pattern. If a reduction of thickness percentage is known (e.g., determined at block 1804 or otherwise known), the texture pattern is determined based on the impression pattern, the reduction of thickness percentage, and the roll diameter, as described herein. The reduction of thickness percentage can be greater than about 5% or greater than about 15%, such as at or about 15%-60%, 20%-50%, 30%-50%, 40%-50%, 20%, 30%, 40%, or 50% reduction of thickness. The texture pattern can be saved into the memory of a computing device (e.g., controller 1618 of FIG. 16).

In some cases, determining the texture pattern can include determining the desired texture roughness in order to result in a desired transfer coefficient between the roll and the metal strip (e.g., based on the roll diameter, cold reduction percentage, and tension difference between the entry and exit of the roll).

At block 1808, the texture pattern is applied to the work roll. The engineered texture pattern can be applied using any suitable technique, including focusing one or more energy beams on the surface of the work roll to impart the texture with a high-degree of precision. Suitable energy beams include laser, electron, plasma, and others.

A beam source can be coupled to a controller to precisely control the application of the texture pattern to the work roll. The controller can also control the relative position of the beam on the work roll (e.g., by manipulation of the beam and/or the work roll). In some cases, the controller can specifically apply the texture pattern so certain elements are applied at desired positions along the width and circumference of the work roll.

For example, texture elements that are used to impart impressions in sheet metal that increase surface friction can be used near the edges of a metal strip, whereas different texture elements that are used to impart different impressions in sheet metal that decrease surface friction can be used near the center of the metal strip. The resultant metal strip with high friction near the edges and low friction near the center may be especially suitable for certain forming (e.g., drawing) where a clamp, drawbead, or other device holds the edges of the metal strip while the center of the metal strip is pressed with a piston, punch, or other device. Other combinations of texture elements can be located in any arrangement or pattern on a metal strip.

In some cases, the controller can read the texture pattern from the memory of the computing device.

At block 1810, the metal strip is rolled using the work roll. The metal strip is rolled at the desired reduction of thickness percentage. The texture pattern imparts the desired impression pattern onto the metal strip during rolling.

Figure 19:
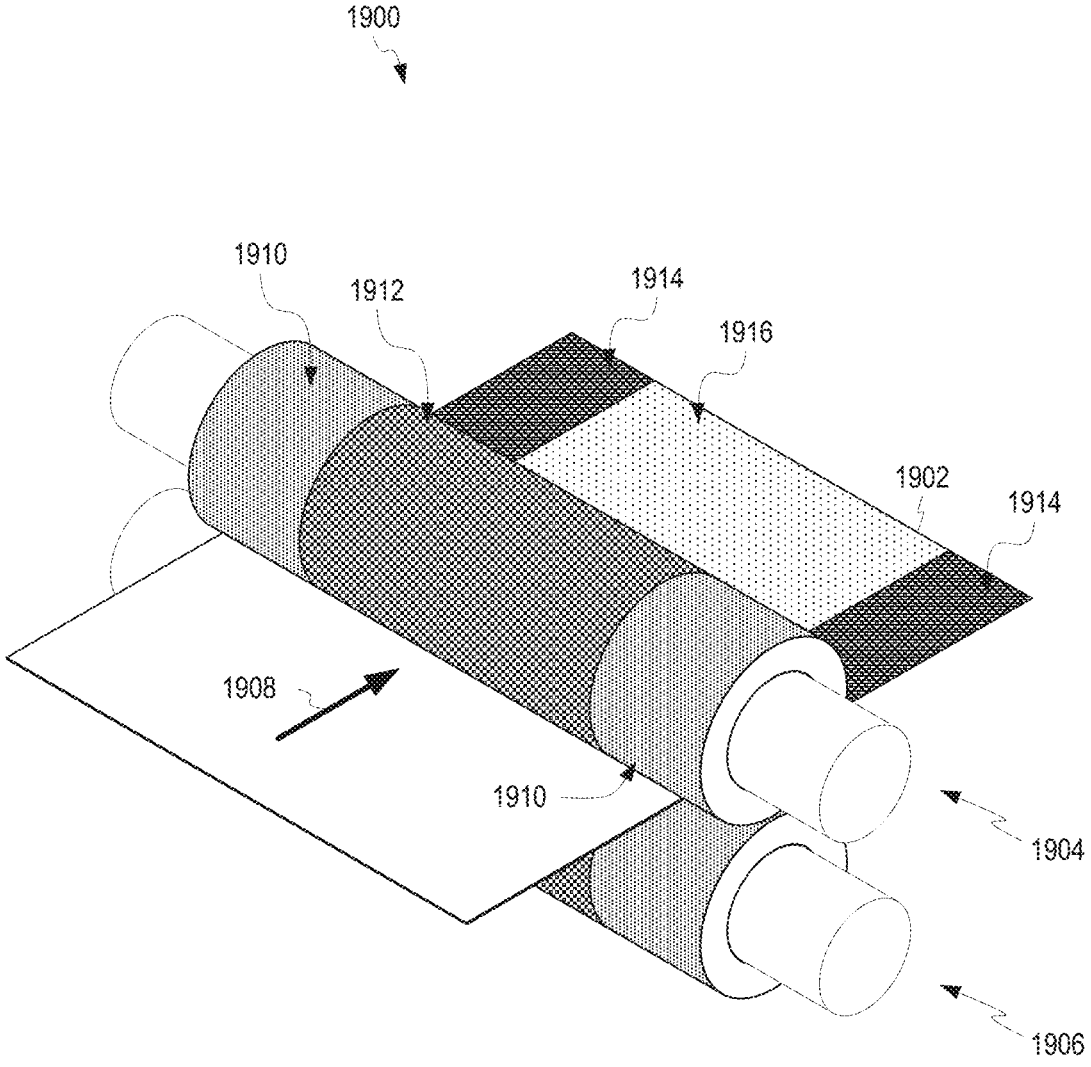
FIG. 19 is an isometric diagram depicting an apparatus for imparting multiple impression patterns on a single metal strip according to certain aspects of the present disclosure.

FIG. 19 is an isometric diagram depicting an apparatus 1900 for imparting multiple impression patterns 1914, 1916 on a single metal strip according to certain aspects of the present disclosure. The apparatus 1900 can include a top work roll 1904 and a bottom work roll 1906. Each work roll 1904, 1906 can have a respective outer surface that contacts the metal strip 1902 during rolling. The metal strip 1902 can have a top surface and a bottom surface, which contact the outer surfaces of the work rolls during rolling. During rolling, the metal strip 1902 can pass through the work rolls 1904, 1906 in direction 1908.

The work rolls 1904, 1906 can have multiple engineered texture patterns 1910, 1912. A first texture pattern 1910 can be designed to impart a specific first impression pattern 1914 on the metal strip to achieve a certain characteristic in the metal strip. For example, the first impression pattern 1914 may contain impression elements that increase friction. The second texture pattern 1912 can be designed to impart a specific second impression pattern 1916 on the metal strip to achieve a different characteristic in the metal strip. For example, the second impression pattern may contain impression elements that decrease friction.

Any suitable number of texture patterns and impression patterns can be used. Texture patterns can be spaced laterally across the roll (e.g., as seen in FIG. 19), circumferentially (e.g., at a single lateral point across the roll, the texture pattern changes as the roll rotates, thus imparting a repeating impression pattern change in the metal strip), or any combination thereof.

Figure 20:
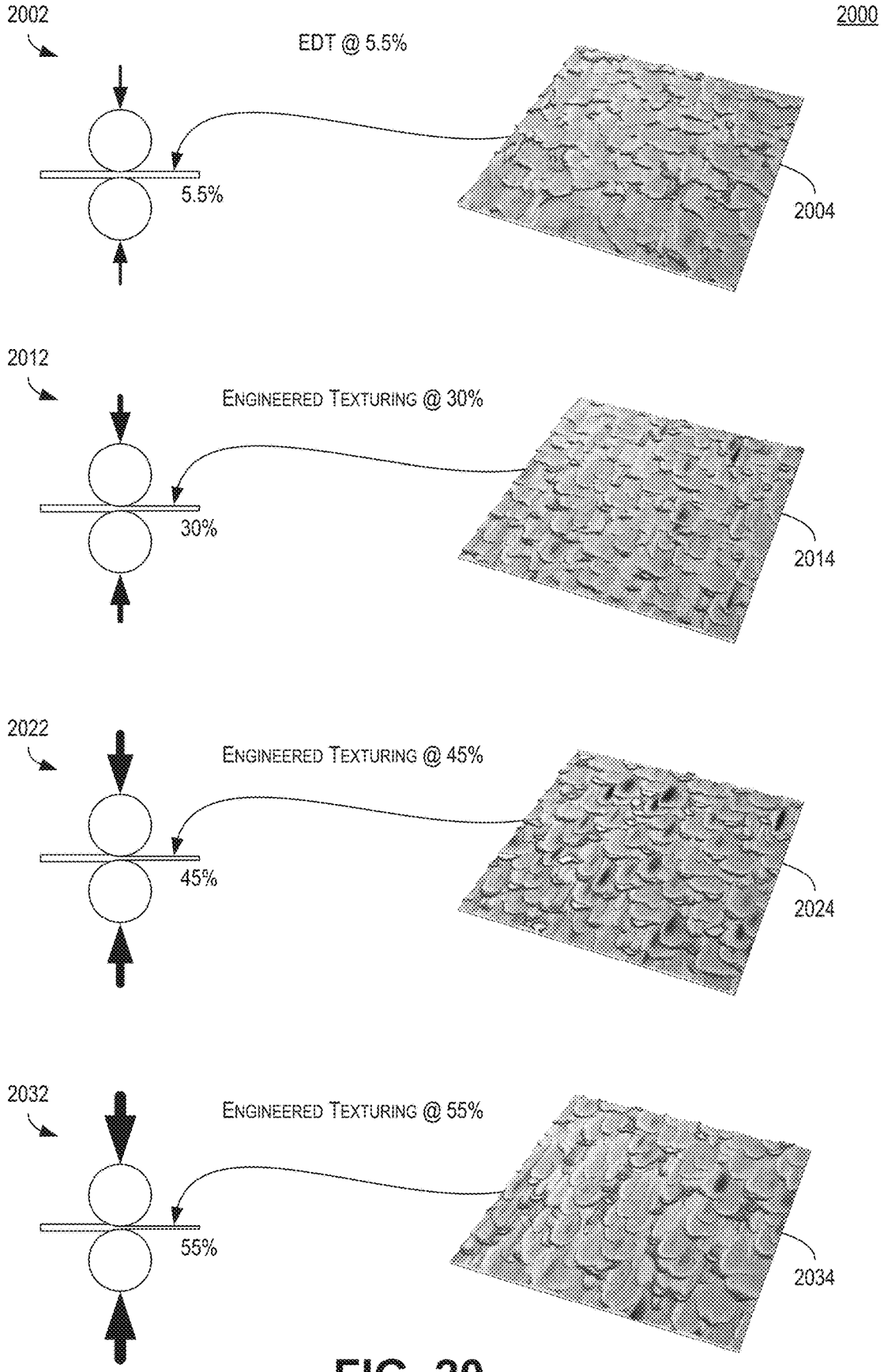
FIG. 20 is a schematic diagram depicting a set of samples of aluminum alloy including a first sample that has been processed according to traditional electrodischarge texturizing (EDT) techniques and second, third, and fourth samples that have been processed according to certain aspects of the present disclosure.

FIG. 20 is a schematic diagram depicting a set 2000 of samples of aluminum alloy including a first sample 2002 that has been processed according to traditional EDT techniques and second, third, and fourth samples 2012, 2022, 2032 that have been processed according to certain aspects of the present disclosure. The first sample 2002 has been rolled at 5.5% reduction of thickness using a finishing roll that has been texturized using traditional EDT techniques, resulting in a surface pattern 2004 of impressions. The second sample 2012 has been rolled at 30% reduction of thickness using a finishing roll that has been texturized using engineered texturing techniques disclosed herein, resulting in a surface pattern 2014 of impressions. The third sample 2022 has been rolled at 45% reduction of thickness using the same finishing roll from the second sample 2012, resulting in a surface pattern 2024 of impressions. The fourth sample 2032 has been rolled at 55% reduction of thickness using the same finishing roll from the second sample 2012, resulting in a surface pattern 2034 of impressions.

As seen in FIG. 20, the surface pattern 2004 of the sample 2002 rolled using EDT techniques at only 5.5% reduction of thickness has a similar surface appearance to the surface patterns 2014, 2024, 2034 of samples 2012, 2022, 2032, respectively. The surface patterns 2004, 2014, 2024, 2034 are depicted as having three-dimensional valleys and hills. The height scale of each of surface patterns 2004, 2014,

2024, 2034 is the same, extending from −4 micron to +4 micron around an average height.

In an experimental case, similar to samples 2012, 2022, 2032 of FIG. 20, an engineered texture pattern was applied to a work roll having a 600.525 mm diameter. The engineered texture pattern was applied using a laser, such as described above with reference to FIG. 16. The engineered texture pattern included a series of elliptical elements aligned with long axes perpendicular to the rolling direction (e.g., similar to that depicted in FIG. 2) and having a ratio of length in the rolling direction (e.g., length of the short axis of the elliptical element) to width (e.g., length of the long axis of the elliptical element) of 1:2.4. In other words, the ratio of the long axis to the short axis is 2.4:1, or 2.4. In some cases, the ratio of the long axis to the short axis can be within 20%, 19%, 18%, 17%, 16%, 15%, 14%, 13%, 12%, 11%, 10%, 9%, 8%, 7%, 6%, 5%, 4%, 3%, 2%, or 1% of 2.4. In some cases, the ratio of the long axis to the short axis can be within the range of 1.5 to 4, within the range of 2 to 3.5, or at or approximately 2.4 or 2.5. The work roll was used in a cold rolling mill to reduce the thickness of a metal strip by various percentages of reduction of thickness. This cold rolling process imparted impressions on the resultant metal strip, which were analyzed and compared with a metal strip rolled using a standard work roll with a standard texture applied via EDT that had been rolled at approximately 5% reduction of thickness. The experimental metal strip was rolled at 30%, 40%, 45%, and 55% reduction of thickness (e.g., an original thickness of 1.85 mm to a final thickness of 1.295, 1.11, and 1.01, as well as an original thickness of 2.20 mm to a final thickness of 1.005 mm, respectively).

The results of this experimental case showed that the various individual elements that made up the impressions on the metal strip texturized by the work roll having engineered textures being applied at reductions of thickness between 30% and 55% achieved favorable, if not improved, characteristics when compared to the metal strip texturized through the standard EDT process at approximately 5% reduction of thickness.

The experimental results for some cases are shown in the comparison Table I, below. The average ratio of individual elements can refer to the anisotropy of the impressions on the metal strip and can be measured as the ratio of width perpendicular to the rolling direction to length in the rolling direction of an individual element of an impression. Ratios closer to 1.0 can be desirable when little or no anisotropy is desired (e.g., when a circular impression is desired). As seen in Table I, engineered textures are capable of producing similar, if not improved, anisotropic characteristics at significantly higher reduction of thickness percentages than is possible with standard EDT. Elements having ratios of 1.0 can be considered circular. Elements having ratios of approximately 1.0, such as within 30%, 25%, 20%, 19%, 18%, 17%, 16%, 15%, 14%, 13%, 12%, 11%, 10%, 9%, 8%, 7%, 6%, 5%, 4%, 3%, 2%, or 1% of 1.0 can be desirable and can be considered as generally circular. For example, an element within 10% of 1.0 can have a ratio between 0.9-1.1.

Various surface characteristics are shown in Table I for different percent reductions of thickness and cold rolling finishing types, including closed void volumes, average ratio of individual elements, average roughness, and peak to peak height. Specifically, the results from rolling with engineered texturized work rolls show measurements similar to standard EDT work rolls with respect to closed void volumes, average roughness, peak to peak height, and average ratio of individual elements. In fact, the closed void volumes of the samples texturized using the work roll with the engineered texture are above that of the sample texturized using a standard work roll with standard EDT, which can result in improved forming.

Further, because some characteristics, such as average roughness and average ratio of individual elements, do not change considerably between the 30%, 45%, and 55% reduction of thickness samples, it is apparent that a particular work roll with a particular engineered texture pattern may be used with favorable results across a wide range of reductions of thickness. In other words, it is not necessary to have two different work rolls with different engineered textures when it is desired to perform finishing operations at two different reductions of thickness. Rather, the same work roll may be used for the first reduction of thickness and then reused for the second, different reduction of thickness. Because a single work roll can be used for a wide range of reductions of thickness, substantial cost and environmental savings can be achieved, as fewer work rolls would be necessary to cover each of the desired reductions of thickness.

TABLE I

| Comparison | | | | |
|---|---|---|---|---|
| Cold Rolling Finishing Description | Standard EDT | Engineered Texture | Engineered Texture | Engineered Texture |
| % Reduction of Thickness | 5% | 30% | 45% | 55% |
| Average Ratio of Individual Elements | 0.8-1.2 | 1.1 | 0.9 | 0.7 |
| Closed Void Volume | 394-460 | 591 | 571 | 510 |
| Average Roughness | 0.83-1.04 | 1.08 | 0.91 | 0.86 |
| Peak-Peak Height | 5.00-5.80 | 7.5 | 5.9 | 5.6 |

Because desirable characteristics can be achieved with engineered texturized work rolls operating at relatively high reduction of thickness percentages as compared to standard EDT work rolls operating at relatively low reduction of thickness percentages, fewer rolling passes may be necessary to produce a desired product, thus providing substantial improvements in cost (e.g., fewer mill stands to purchase, maintain, and operate), time (e.g., fewer passes can speed up the overall process), and safety (e.g., fewer pieces of dangerous equipment and fewer dangerous operations to perform).

Finally, a visual inspection test and a painting test were performed to compare the samples texturized using work rolls with engineered textures to the samples texturized using standard work rolls with standard EDT textures. The visual inspection showed that the resultant impressions on the resultant metal strip was similar for all samples, despite the samples texturized using the engineered textured work rolls being rolled at much higher reductions of thickness. The painting test showed that results at least as good, if not better, than the samples texturized using standard work rolls with standard EDT textures can be achieved by samples texturized using work rolls with engineered textures.

Figure 21:
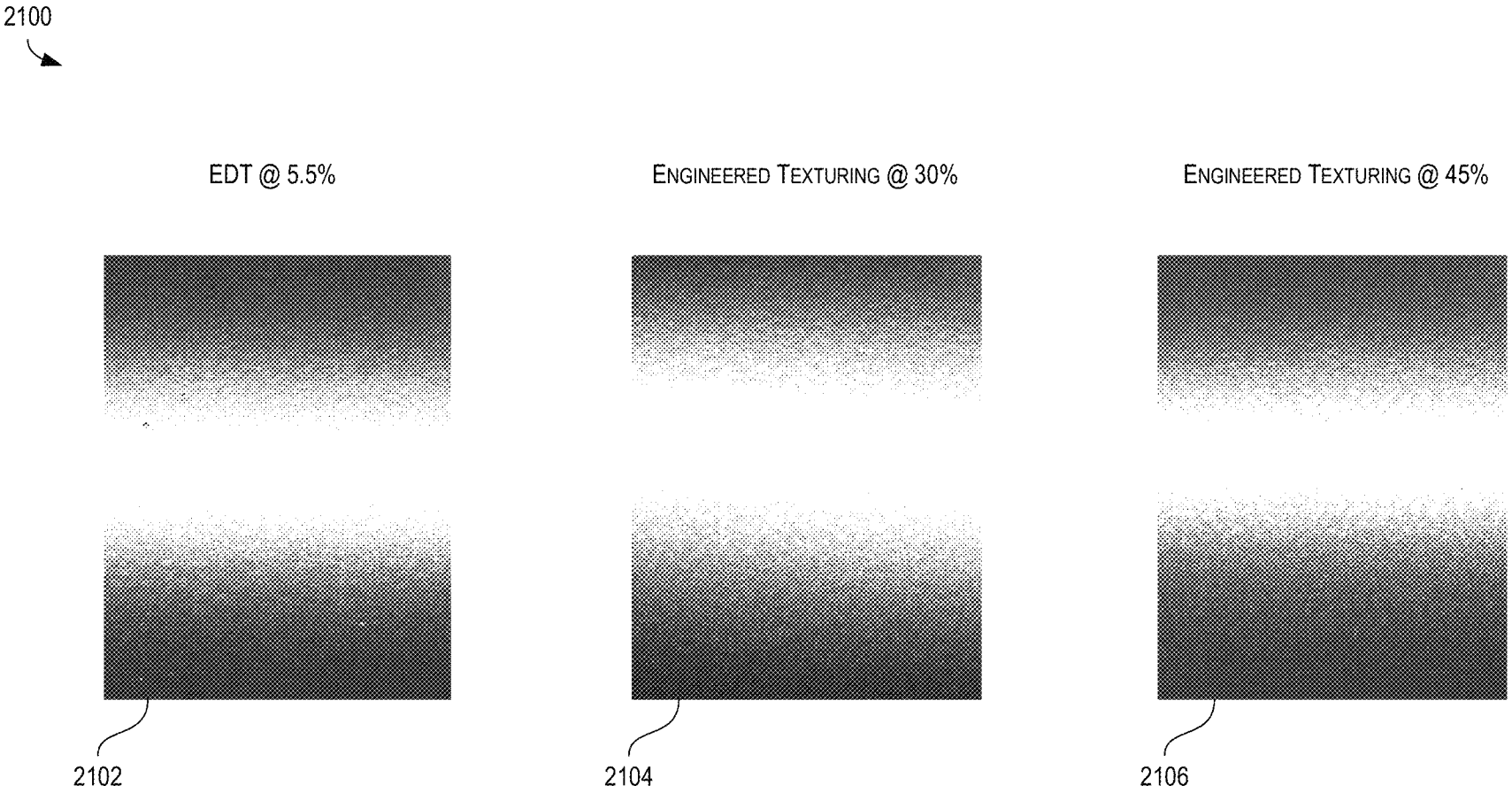
FIG. 21 is a set of photographs of metal samples comparing painting test results of a metal sample rolled using a roller prepared using EDT techniques with metal samples rolled at 30% and 45% using rollers prepared using engineered textures as described in further detail herein according to certain aspects of the present disclosure.

FIG. 21 is a set of photographs 2100 of metal samples 2102, 2104, 2106 comparing painting test results of a metal sample 2102 rolled using a roller prepared using EDT techniques (e.g., rolled at 5% with a roller having textures created using EDT) with metal samples 2104, 2106 rolled at 30% and 45%, respectively, using rollers prepared using engineered textures as described in further detail herein according to certain aspects of the present disclosure. The painting was performed using e-coat painting involving painting the metal samples in an electrolytic bath. As seen in FIG. 21, the painting tests of the EDT sample 2102 and the engineered texture samples 2104, 2106 show similar, acceptable performance. Therefore, metal rolled using the engineered textures as disclosed herein can be rolled at relatively high reductions of thickness without negatively affecting the painting functionality and appearance.

Figure 22:
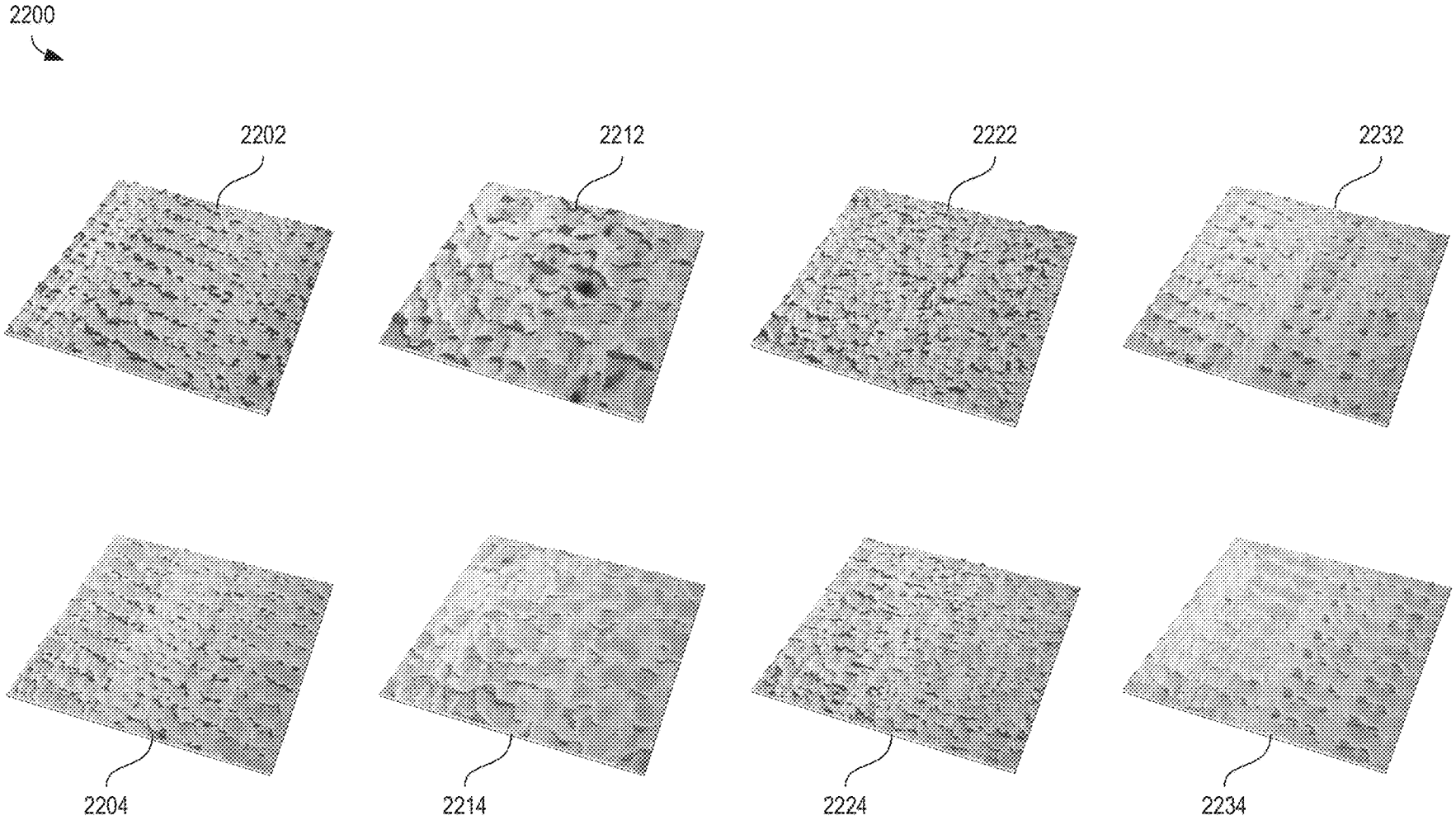
FIG. 22 is a collection of three-dimensional images depicting the impressions on the surface of an aluminum metal strip after having been rolled at approximately 5% reduction of thickness using a work roll having engineered texture patterns according to certain aspects of the present disclosure.

FIG. 22 is a collection 2200 of three-dimensional images depicting the impressions on the surface of an aluminum metal strip after having been rolled at approximately 5% reduction of thickness using a work roll having engineered texture patterns according to certain aspects of the present disclosure. In this experimental case, several engineered texture patterns were applied at different lateral locations along a single work roll having a 591.88 mm diameter. The engineered texture patterns were applied using a laser, such as described above with reference to FIG. 16. Certain sample engineered texture patterns were used, including a mixture of large and small textures, a texture designed to mimic EDT texture, a texture of primarily small craters, and a texture of primarily large craters. The mixture of large and small textures was used to generate samples 2202, 2204. The texture designed to mimic EDT texture was used to generate samples 2212, 2214. The texture of primarily small craters was used to generate samples 2222, 2224. The texture of primarily large craters was used to generate samples 2232, 2234.

Samples 2202, 2212, 2222, 2242 were generated using a work roll having freshly-prepared engineered textures. Samples 2204, 2214, 2224, 2234 were generated using the same work roll of samples 2202, 2212, 2222, 2242 after the work roll had been treated to decrease its average roughness. The work roll was treated by running the work roll against another roll to wear down any exposed peaks. Samples 2202, 2212, 2222, 2232, 2204, 2214, 2224, 2234 are all portions of aluminum metal strip that had been reduced in thickness by the aforementioned work roll having engineered texture patterns, resulting in the impressions depicted in the collection 2200 of images.

The various engineered texture patterns used may include several different sets of overlapping elements, such as those depicted in FIGS. 12-14. The work roll was used in a cold rolling mill to reduce the thickness of a metal strip by approximately 5% reduction of thickness (e.g., an original thickness of 1.064 mm to a final thickness of approximately 1.005 mm). This cold rolling process imparted impressions on the resultant metal strip, which were analyzed individually and compared with a metal strip rolled using a standard work roll with a standard texture applied via EDT that had been rolled at approximately 5% reduction of thickness. The overlapping elements of the engineered texture pattern were selected to increase the closed void volume and provide other beneficial surface characteristics. A higher closed void volume can improve the retention of lubricants for forming. The overlapping elements may also increase the nominal surface contact area of the metal's surface, which can allow the surface to carry higher loads during drawing and thus enabling improved resistance to high drawbead pressure (e.g., better able to retain constant friction with time and pressure).

As seen in FIG. 22, a wide range of impressions can be generated on a metal strip reduced in thickness by relatively low amounts (e.g., approximately 5% or at least under 30%) when engineered textures are employed. The wide range of impressions can allow surface characteristics to be specifically tailored to a desired need. The use of standard EDT cannot provide these improved and tailored characteristics on rolled metal. For example, engineered texture patterns may be specifically tailored for use on a roller that is used to cold roll a metal strip, giving the resultant metal strip a specifically tailored pattern of impressions that provide for improved forming, friction and/or drawing characteristics. Surprisingly, the samples 2232, 2234 made with a large crater texture pattern do not result in impressions that are larger or significantly larger than traditional EDT.

Figure 23:
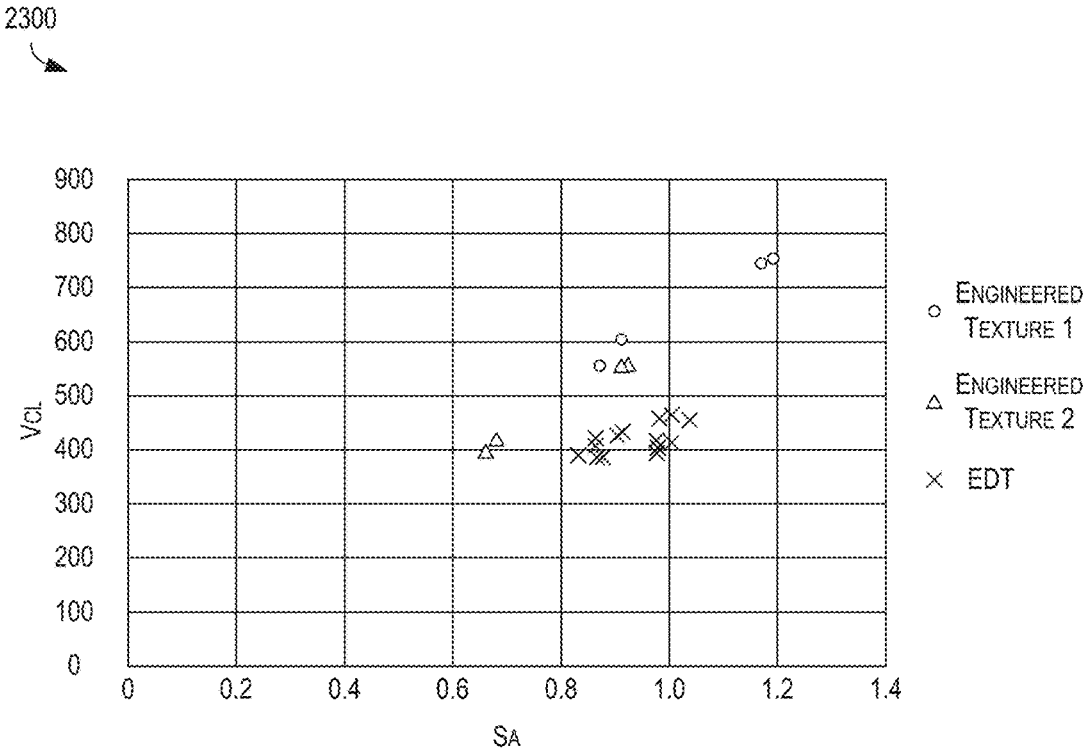
FIG. 23 is a chart depicting surface roughness and volume of closed voids for metal strip samples rolled with a work roll having engineered textures according to certain aspects of the present disclosure as compared to metal strip samples rolled with a work roll having traditional EDT.

FIG. 23 is a chart 2300 depicting surface roughness and volume of closed voids for metal strip samples rolled with a work roll having engineered textures according to certain aspects of the present disclosure as compared to metal strip samples rolled with a work roll having traditional EDT. The sample rolled with a work roll having engineered textures can be the same as sample 2212 and 2214 of FIG. 22, and can have a much higher volume of closed voids for the same or approximately the same average surface roughness as compared to the samples rolled with a work roll having traditional EDT.

Figure 24:
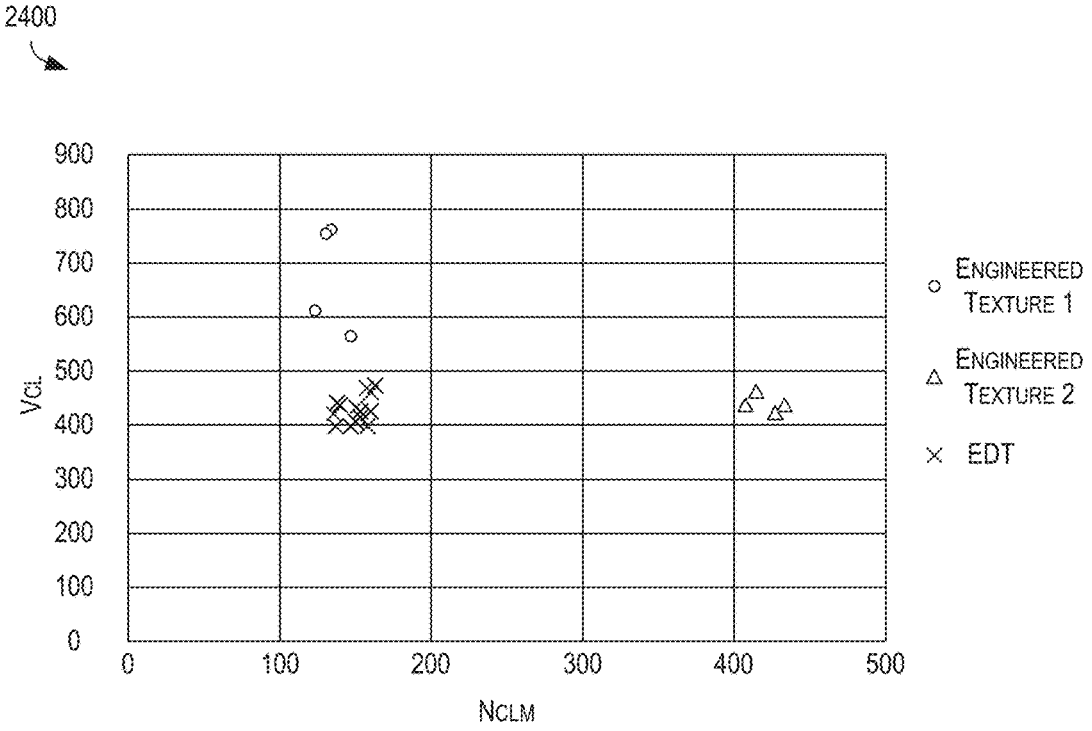
FIG. 24 is a chart depicting the number of lubricant pockets and volume of closed voids for metal strip samples rolled with a work roll having engineered textures according to certain aspects of the present disclosure as compared to metal strip samples rolled with a work roll having traditional EDT.

FIG. 24 is a chart 2400 depicting the number of lubricant pockets ($N_{clm}$) and volume of closed voids for metal strip samples rolled with a work roll having engineered textures according to certain aspects of the present disclosure as compared to metal strip samples rolled with a work roll having traditional EDT. The number of lubricant pockets can be an indication of how fine the impressions are on the metal strip, with a higher $N_{clm}$ indicative of finer, or smaller, impressions. The Engineered Texture 1 sample can be the sample 2212 of FIG. 22, showing a much higher volume of closed voids for the same or approximately the same number of lubricant pockets or texture fineness as compared to the samples rolled with a work roll having traditional EDT. The Engineered Texture 2 sample can be the sample 2222 of FIG. 22, showing a much higher number of lubricant pockets or texture fineness for the same or approximately the same volume of closed voids as compared to the samples rolled with a work roll having traditional EDT. Thus, engineered textures can be specifically tailored for certain desired characteristics. For example, if a metal strip is desired to have more trapped lubricant during a specific drawing or forming process, the metal strip may be rolled with a work roll having an engineered texture similar to that of sample 2212 of FIG. 22. Chart 2400 interestingly shows that when using engineered textures, it is possible to achieve higher volume of closed voids with the same average crater size, or achieve the same volume of closed voids with a smaller crater size.

Figure 25:
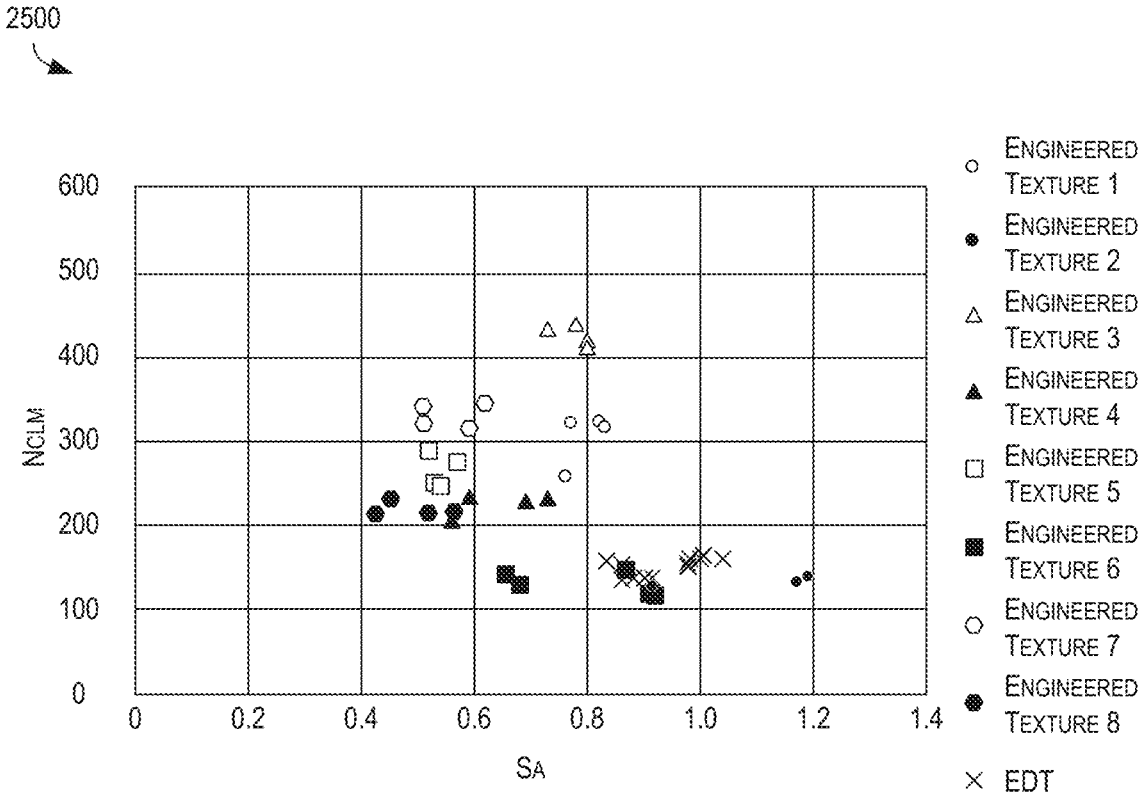
FIG. 25 is a chart depicting the average surface roughness and number of lubricant pockets for metal strip samples rolled with a work roll having engineered textures according to certain aspects of the present disclosure as compared to metal strip samples rolled with a work roll having traditional EDT.

FIG. 25 is a chart 2500 depicting the average surface roughness and number of lubricant pockets ($N_{clm}$) for metal strip samples rolled with a work roll having engineered textures according to certain aspects of the present disclosure as compared to metal strip samples rolled with a work roll having traditional EDT. As mentioned above, the number of lubricant pockets can be an indication of how fine the impressions are on the metal strip, with a higher $N_{clm}$ indicative of finer, or smaller, impressions. The Engineered Texture 1 sample can be the sample 2202 of FIG. 22, the Engineered Texture 2 sample can be the sample 2212 of FIG. 22, the Engineered Texture 3 sample can be the sample 2222 of FIG. 22, the Engineered Texture 4 sample can be the sample 2232 of FIG. 22, the Engineered Texture 5 sample can be the sample 2204 of FIG. 22, the Engineered Texture 6 sample can be the sample 2214 of FIG. 22, the Engineered Texture 7 sample can be the sample 2224 of FIG. 22, and the Engineered Texture 8 sample can be the sample 2234 of FIG. 22. As seen in FIG. 25, the size of the craters (e.g., as indicated by the number of lubricant pockets, where a higher number of lubricant pockets is indicative of smaller overall crater sizes) can be varied across different engineered textures independently of average roughness. For example, the samples of Engineered Textures 1, 3, and 6 all have approximately the same average roughness as the EDT sample, yet with quite varied crater size (e.g., from Nclm values ranging from approximately 150 up to approximately 450, as compared to EDT's Nclm value of approximately 150).

The results of the experimental cases depicted across FIGS. 22-25 show that the various engineered textures were able to impart resultant impressions having significantly higher maximum number of lubricant pockets (e.g., finer texture) for a given average surface roughness as compared to a standard EDT texture. The results further showed that the engineered texture was able to impart resultant impressions having a significantly higher volume of closed voids for a given average surface roughness as compared to a standard EDT texture. While greater volume of closed voids can be achieved by increasing surface roughness, it can be desirable to increase the volume of closed voids without increasing the surface roughness because of painting issues that can arise with increased surface roughness. Therefore, the ability to achieve higher volume of closed voids for a given surface roughness, which is achieved with engineered textures, can be desirable over the lower volume of closed voids for the same surface roughness, which is achieved using standard EDT textures. It is also interesting that, for the same surface roughness, an engineered texture with fine holes and a high number of lubricant pockets can have approximately the same volume of closed voids as an engineered texture with large holes and a low number of lubricant pockets, which can also have approximately the same volume of closed voids as when a traditional EDT technique is used. Since small holes can be more resistant during drawing, the positive effect of a high volume of closed voids and small holes can be combined in a single metal strip, which can be desirable for certain drawing processes.

In some cases, it has been found that the engineered texture was able to impart resultant impressions having a significantly higher maximum number of material areas for a given average surface roughness as compared to a standard EDT texture.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a method comprising: determining a desired impression pattern for a metal strip; determining a texture pattern for a work roll of a cold-rolling mill stand, wherein the texture pattern includes a plurality of elements and wherein determining the texture pattern includes calculating one or more dimensions of the plurality of elements such that the texture pattern imparts the desired impression pattern at a reduction of thickness percentage; and applying the texture pattern to the work roll, wherein the texture pattern of the work roll imparts the desired impression pattern on the metal strip when the metal strip is rolled by the work roll at the reduction of thickness percentage.

Example 2 is the method of example 1, wherein the desired impression pattern includes a plurality of generally circular elements. An average ratio of length to width of the plurality of generally circular elements can be within 30% of 1.0, and the reduction of thickness percentage can be greater than 5%.

Example 3 is the method of example 2, wherein the desired impression pattern includes isotropic groupings, wherein each of the isotropic groupings includes a subset of the plurality of generally circular elements positioned in an overlapping, isotropic pattern.

Example 4 is the method of examples 1-3, wherein the desired impression pattern includes a plurality of generally elliptical elements having long axes oriented at approximately 45° angles to a rolling direction.

Example 5 is the method of examples 1-4, wherein applying the texture pattern to the work roll includes using a beam to produce the plurality of elements of the texture pattern.

Example 6 is the method of example 5, wherein the beam is selected from a laser beam, an electron beam, and a plasma beam.

Example 7 is the method of examples 5 or 6, wherein applying the texture pattern further includes using an additional beam in combination with the beam to produce the plurality of elements of the texture pattern.

Example 8 is the method of examples 1-7, wherein the reduction of thickness percentage is greater than approximately 5%.

Example 9 is the method of examples 1-7, wherein the reduction of thickness percentage is greater than approximately 15%.

Example 10 is the method of examples 1-7, wherein the reduction of thickness percentage is greater than approximately 20%.

Example 11 is the method of examples 1-7, wherein the reduction of thickness percentage is greater than approximately 30%.

Example 12 is the method of examples 1-7, wherein the reduction of thickness percentage is greater than approximately 40%.

Example 13a is the method of examples 1-7, wherein the reduction of thickness percentage is greater than approximately 50%.

Example 13b is the method of examples 1-13a, wherein the plurality of elements include elliptical elements each having a long axis oriented perpendicular to a rolling direction and a short axis, and wherein an average ratio of the long axis to the short axis of the elliptical elements is between 1.5 and 4.

Example 13c is the method of examples 1-13a, wherein the plurality of elements include elliptical elements each having a long axis oriented perpendicular to a rolling direction and a short axis, and wherein an average ratio of the long axis to the short axis of the elliptical elements is at or approximately 3.5.

Example 13d is the method of examples 1-13a, wherein the plurality of elements include elliptical elements each having a long axis oriented perpendicular to a rolling direction and a short axis, and wherein an average ratio of the long axis to the short axis of the elliptical elements is between 4 and 10.

Example 13e is the method of examples 1-13a, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number between 1.5 and 4.

Example 13f is the method of examples 1-13a, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number at or approximately 3.5.

Example 13g is the method of examples 1-13a, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number between 4 and 10.

Example 14 is a metal strip, comprising: a surface having an impression pattern, wherein the impression pattern comprises a plurality of elements formed during cold-rolling of the metal strip by a work roll having an engineered texture pattern corresponding to the impression pattern.

Example 15 is the metal strip of example 14, wherein cold-rolling of the metal strip includes reducing a thickness of the metal strip by greater than approximately 5%.

Example 16 is the metal strip of example 14, wherein cold-rolling of the metal strip includes reducing a thickness of the metal strip by greater than approximately 15%.

Example 17 is the metal strip of example 14, wherein cold-rolling of the metal strip includes reducing the thickness of the metal strip by greater than approximately 20%.

Example 18 is the metal strip of example 14, wherein cold-rolling of the metal strip includes reducing the thickness of the metal strip by greater than approximately 30%.

Example 19 is the metal strip of example 14, wherein cold-rolling of the metal strip includes reducing the thickness of the metal strip by greater than approximately 40%.

Example 20 is the metal strip of example 14, wherein cold-rolling of the metal strip includes reducing the thickness of the metal strip by greater than approximately 50%.

Example 21 is the metal strip of examples 14-20, wherein the plurality of elements include a plurality of generally circular elements. An average ratio of length to width of each of the plurality of generally circular elements can be within 30% of 1.0. In some cases, the average ratio of length to width of each of the plurality of generally circular elements can be within 10% of 1.0.

Example 22 is the metal strip of examples 14-20, wherein the plurality of elements include a plurality of generally circular elements having radii of approximately 50 microns to approximately 100 microns.

Example 23 is the metal strip of examples 21 or 22, wherein the plurality of elements include an additional plurality of generally circular elements having radii of approximately 20 microns to approximately 50 microns.

Example 24 is the metal strip of examples 14-20, wherein the plurality of elements include a plurality of generally circular elements having radii of approximately 100 microns to approximately 150 microns.

Example 25 is the metal strip of example 24, wherein the plurality of elements include an additional plurality of generally circular elements having radii of approximately 20 microns to approximately 50 microns.

Example 26 is the metal strip of examples 24 or 25, wherein the plurality of elements include an additional plurality of generally circular elements having radii of approximately 50 microns to approximately 100 microns. In some cases, the plurality of generally circular elements can have radii of approximately 50 microns to approximately 150 microns. In some cases, the plurality of generally circular elements can have radii of approximately 75 microns to approximately 150 microns.

Example 27 is the metal strip of examples 21-26, wherein the plurality of generally circular elements have depths of approximately 0.05 microns to approximately 7 microns.

Example 28 is the metal strip of example 27, wherein the plurality of elements further include an additional plurality of generally circular elements having depths of approximately 0.05 microns to approximately 2 microns.

Example 29 is the metal strip of examples 21-26, wherein the plurality of generally circular elements have depths of approximately 0.05 microns to approximately 2 microns.

Example 30 is the metal strip of examples 14-29, wherein the plurality of elements are arranged in a random or pseudo-random fashion.

Example 31 is the metal strip of examples 14-30, wherein the plurality of elements includes a plurality of generally elliptical elements having long axes oriented at approximately 45° angles to a rolling direction.

Example 32 is a work roll, comprising an outer surface having a texture pattern, wherein the texture pattern comprises a plurality of elements formed by controlled application of an energy beam to the outer surface, and wherein the plurality of elements have at least one non-random parameter.

Example 33 is the work roll of example 32, wherein the plurality of elements includes a plurality of generally elliptical elements each having a long axis parallel to a width of the work roll.

Example 34 is the work roll of examples 32 or 33, wherein the plurality of elements includes elements designed to impart an impression on a metal strip, when the metal strip is rolled by the work roll, that improves a characteristic of the metal strip.

Example 35 is the work roll of examples 32 or 33, wherein each of the plurality of elements is shaped to impart a generally circular impression on a metal strip when the work roll is used to cold roll the metal strip with a reduction of thickness greater than approximately 5%. In some cases, each of the plurality of elements has a long axis oriented perpendicular to a rolling direction and a short axis, and an average ratio of the long axis to the short axis of the plurality of elements is between 1.5 and 4.

Example 36 is the work roll of example 35, wherein the reduction of thickness is greater than approximately 15%.

Example 37 is the work roll of example 35, wherein the reduction of thickness is greater than approximately 20%.

Example 38 is the work roll of example 35, wherein the reduction of thickness is greater than approximately 30%.

Example 39 is the work roll of example 35, wherein the reduction of thickness is greater than approximately 40%.

Example 40 is the work roll of example 35, wherein the reduction of thickness is greater than approximately 50%.

Example 41 is the work roll of examples 32-40, wherein the plurality of elements are arranged in a random or pseudo-random fashion.

Example 42 is the work roll of examples 32-41, wherein the plurality of elements include a plurality of generally elliptical elements having long axes oriented at approximately 45° angles to a rolling direction.

Example 43 is a method, comprising: determining a desired impression pattern for a metal strip; determining a texture pattern for a work roll of a cold-rolling mill stand, wherein the texture pattern includes a plurality of elements and wherein determining the texture pattern includes calculating one or more dimensions of the plurality of elements such that the texture pattern imparts the desired impression pattern at a reduction of thickness percentage; and applying the texture pattern to the work roll, wherein the texture pattern of the work roll imparts the desired impression pattern on the metal strip when the metal strip is rolled by the work roll at the reduction of thickness percentage.

Example 44 is the method of example 43, wherein the desired impression pattern includes a plurality of generally circular elements, wherein an average ratio of length to width of the plurality of generally circular elements is within 30% of 1.0, and wherein the reduction of thickness percentage is greater than 5%.

Example 45 is the method of example 44, wherein the desired impression pattern includes isotropic groupings, wherein each of the isotropic groupings includes a subset of the plurality of generally circular elements positioned in an overlapping, isotropic pattern.

Example 46 is the method of examples 44 or 45, wherein the desired impression pattern includes a plurality of generally elliptical elements having long axes oriented at approximately 45° angles to a rolling direction.

Example 47 is the method of examples 43-46, wherein the reduction of thickness percentage is greater than approximately 20%.

Example 48 is the method of examples 43-47, wherein the reduction of thickness percentage is greater than 35% and less than 50%, wherein the texture pattern of the work roll imparts the desired impression pattern on the metal strip when the metal strip is rolled by the work roll at a second reduction of thickness percentage that is greater than 30% and less than 55%. The second reduction of thickness can be different than the reduction of thickness.

Example 49 is the method of examples 43-48, wherein the plurality of elements include elliptical elements each having a long axis oriented perpendicular to a rolling direction and a short axis, and wherein an average ratio of the long axis to the short axis of the elliptical elements is between 1.5 and 4 or between 4 and 10. The ratio can be between 1.5 and 4. The ratio can be between 4 and 10. The ratio can be between 2 and 3.5. The ratio can be at or approximately 2.5.

Example 50a is the method of examples 43-49, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number between 1.5 and 4 or between 4 and 10. The ratio can be between 1.5 and 4. The ratio can be between 4 and 10. The ratio can be between 2 and 3.5. The ratio can be at or approximately 2.5.

Example 50b is a method of examples 1-50a, wherein the desired impression pattern includes a plurality of generally elliptical elements have long axes oriented at angles between 45° to 90° with respect to a rolling direction. The reduction of thickness percentage can be between 30% and 55%. The reduction of thickness percentage can be between approximately 5%.

Example 50c is a method of examples 1-50b, wherein the desired impression pattern includes a first plurality of generally elliptical elements and a second plurality of generally elliptical elements, wherein an average size of the elements of the first plurality of generally elliptical elements is different than an average size of the elements of the second plurality of generally elliptical elements, and wherein the reduction of thickness percentage is greater than 5%. The reduction of thickness percentage can be between 30% and 55%. In some cases, including Example 50c and other examples herein, average size of a generally circular element can includes its average radius or diameter. In some cases, average size of a generally circular element can include its average volume or depth.

Example 50d is a method of examples 1-50c, wherein the desired impression pattern includes a plurality of generally circular elements and a plurality of generally elliptical elements, and wherein the reduction of thickness percentage is greater than 5%. The reduction of thickness percentage can be between 30% and 55%.

Example 50e is a method of examples 1-50d, wherein the desired impression pattern includes a first plurality of generally circular elements and a second plurality of generally circular elements, wherein an average size of the elements of the first plurality of generally circular elements is different than an average size of the elements of the second plurality of generally circular elements, and wherein the reduction of thickness percentage is greater than 5%. The reduction of thickness percentage can be between 30% and 55%.

Example 51 is a metal strip, comprising a surface having a pre-determined impression pattern, wherein the impression pattern comprises a plurality of elements formed during cold-rolling of the metal strip by a work roll having an engineered texture pattern tailored to generate the pre-determined impression pattern.

Example 52 is the metal strip of example 51, wherein the plurality of elements formed during the cold-rolling of the metal strip were formed during reduction of a thickness of the metal strip by greater than approximately 5%.

Example 53 is the metal strip of examples 51 or 52, wherein the plurality of elements formed during the cold-rolling of the metal strip were formed during reduction of the thickness of the metal strip by greater than approximately 20%.

Example 54 is the metal strip of examples 51-53, wherein the plurality of elements include a plurality of generally circular elements, wherein an average ratio of length to width of each the plurality of generally circular elements is within 30% of 1.0, and wherein the reduction of thickness percentage is greater than 5%.

Example 55 is the metal strip of examples 51-54, wherein the plurality of elements include a plurality of generally circular elements having radii of approximately 50 microns to approximately 100 microns.

Example 56 is the metal strip of example 55, wherein the plurality of elements include an additional plurality of generally circular elements having radii of approximately 20 microns to approximately 50 microns.

Example 57a is the metal strip of examples 51-56, wherein the plurality of elements includes a plurality of generally elliptical elements having long axes oriented at approximately 45° angles to a rolling direction.

Example 57b is a metal strip of examples 51-57a, wherein the plurality of elements includes a plurality of generally elliptical elements having long axes oriented at approximately 90° angles to a rolling direction. The plurality of elements formed during the cold-rolling of the metal strip may be formed during reduction of a thickness of the metal strip by approximately 5%. The plurality of elements formed during the cold-rolling of the metal strip may be formed during reduction of a thickness of the metal strip by greater than approximately 5%, such as 30% to 55%.

Example 57c is a metal strip of examples 51-57b, wherein the plurality of elements includes a first plurality of generally elliptical elements and a second plurality of generally elliptical elements, wherein an average size of the elements of the first plurality of generally elliptical elements is different than an average size of the elements of the second plurality of generally elliptical elements, and wherein the plurality of elements formed during the cold-rolling of the metal strip were formed during reduction of a thickness of the metal strip by greater than approximately 5%. The reduction of thickness percentage can be between 30% and 55%.

Example 57d is a metal strip of examples 51-57c, wherein the plurality of elements includes a plurality of generally circular elements and a plurality of generally elliptical elements, and wherein the plurality of elements formed during the cold-rolling of the metal strip were formed during reduction of a thickness of the metal strip by greater than approximately 5%. The reduction of thickness percentage can be between 30% and 55%.

Example 57e is a method of examples 1-57d, wherein the plurality of elements includes a first plurality of generally circular elements and a second plurality of generally circular elements, wherein an average size of the elements of the first plurality of generally circular elements is different than an average size of the elements of the second plurality of generally circular elements, and wherein the plurality of elements formed during the cold-rolling of the metal strip were formed during reduction of a thickness of the metal strip by greater than approximately 5%. The reduction of thickness percentage can be between 30% and 55%.

Example 58 is a work roll comprising an outer surface having a texture pattern, wherein the texture pattern comprises a plurality of elements formed by controlled application of an energy beam to the outer surface, and wherein the plurality of elements have at least one non-random parameter.

Example 59 is the work roll of example 58, wherein the plurality of elements includes a plurality of generally elliptical elements each having a long axis parallel to a width of the work roll, wherein each of the plurality of generally elliptical elements is shaped to impart a generally circular impression on a metal strip when the work roll is used to cold roll the metal strip with a reduction of thickness greater than approximately 5%.

Example 60 is the work roll of example 59, an average ratio of the long axis to the short axis of the plurality of generally elliptical elements is at or approximately 2.5. In some cases, the average ration can be between 1.5 and 4 or between 4 and 10. In some caes, the average ration can be between 2 and 3.5

Example 61 is the work roll of examples 58-60, wherein the texture pattern is engineered to impart generally circular impressions on a metal strip when the work roll is used to cold roll the metal strip with a reduction of thickness between 30% and 55%, and wherein the generally circular impressions have an average ratio of length to width that is within 30% of 1.0.

Example 62 is the work roll of examples 58-61, wherein the plurality of elements includes a plurality of generally elliptical elements having long axes oriented at angles between 45° to 90° with respect to a rolling direction.

Example 63 is the work roll of examples 58-62, wherein the texture pattern is engineered to impart a first plurality of generally elliptical impressions and a second plurality of generally elliptical impressions, wherein an average size of the impressions of the first plurality of generally elliptical impressions is different than an average size of the elements of the second plurality of generally elliptical impressions when the work roll is used to roll a metal strip at a reduction of thickness percentage greater than 5%. The reduction of thickness percentage can be between 30% and 55%.

Example 64 is the work roll of examples 58-63, wherein the texture pattern is engineered to impart a plurality of generally circular impressions and a plurality of generally elliptical impressions when the work roll is used to roll a metal strip at a reduction of thickness percentage greater than 5%. The reduction of thickness percentage can be between 30% and 55%.

Example 65 is the work roll of examples 58-63, wherein the texture pattern is engineered to impart a first plurality of generally circular impressions and a second plurality of generally circular impressions, wherein an average size of the impressions of the first plurality of generally circular impressions is different than an average size of the elements of the second plurality of generally circular impressions when the work roll is used to roll a metal strip at a reduction of thickness percentage greater than 5%. The reduction of thickness percentage can be between 30% and 55%.

What is claimed is:

1. A method, comprising:

determining a desired impression pattern for a metal strip;

determining a texture pattern for a work roll of a cold-rolling mill stand, wherein the texture pattern includes a plurality of elements and wherein determining the texture pattern includes calculating one or more dimensions of the plurality of elements such that the texture pattern imparts the desired impression pattern at a reduction of thickness percentage; and applying the texture pattern to the work roll, wherein the texture pattern of the work roll imparts the desired impression pattern on the metal strip when the metal strip is rolled by the work roll at the reduction of thickness percentage, wherein the desired impression pattern includes a plurality of generally circular elements, wherein an average ratio of length to width of the plurality of generally circular elements is within 30% of 1.0, and wherein the reduction of thickness percentage is greater than 5%.

2. The method of claim 1, wherein the desired impression pattern includes isotropic groupings, wherein each of the isotropic groupings includes a subset of the plurality of generally circular elements positioned in an overlapping, isotropic pattern.

3. The method of claim 1, wherein the desired impression pattern includes a plurality of generally elliptical elements having long axes oriented at approximately 45° angles to a rolling direction.

4. The method of claim 1, wherein the reduction of thickness percentage is greater than approximately 20%.

5. The method of claim 1, wherein the reduction of thickness percentage is greater than 35% and less than 50%, wherein the texture pattern of the work roll imparts the desired impression pattern on the metal strip when the metal strip is rolled by the work roll at a second reduction of thickness percentage that is greater than 30% and less than 55%.

6. The method of claim 1, wherein the plurality of elements include elliptical elements each having a long axis oriented perpendicular to a rolling direction and a short axis, and wherein an average ratio of the long axis to the short axis of the elliptical elements is between 1.5 and 4.

7. The method of claim 1, wherein the plurality of elements include elliptical elements each having a long axis oriented perpendicular to a rolling direction and a short axis, and wherein an average ratio of the long axis to the short axis of the elliptical elements is between 2 and 3.5.

8. The method of claim 1, wherein the plurality of elements include elliptical elements each having a long axis oriented perpendicular to a rolling direction and a short axis, and wherein an average ratio of the long axis to the short axis of the elliptical elements is between 4 and 10.

9. The method of claim 1, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number between 1.5 and 4.

10. The method of claim 1, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number between 2 and 3.5.

11. The method of claim 1, wherein the desired impression pattern includes elements having an average diameter, wherein the plurality of elements of the texture pattern includes elliptical elements each having a long axis oriented perpendicular to a rolling direction and a short axis, and wherein calculating one or more dimension of the plurality of elements includes using the average diameter as a desired long axis of the elliptical elements and calculating a desired short axis of the elliptical elements by dividing the average diameter by a number between 4 and 10.

12. The method of claim 1, wherein the desired impression pattern includes a plurality of generally elliptical elements having long axes oriented at angles between 45° to 90° with respect to a rolling direction.

13. The method of claim 1, wherein the desired impression pattern includes a first plurality of generally elliptical elements and a second plurality of generally elliptical elements, wherein an average size of the elements of the first plurality of generally elliptical elements is different than an average size of the elements of the second plurality of generally elliptical elements, and wherein the reduction of thickness percentage is greater than 5%.

14. The method of claim 1, wherein the desired impression pattern includes a plurality of generally circular elements and a plurality of generally elliptical elements, and wherein the reduction of thickness percentage is greater than 5%.

15. The method of claim 1, wherein the desired impression pattern includes a first plurality of generally circular elements and a second plurality of generally circular elements, wherein an average size of the elements of the first plurality of generally circular elements is different than an average size of the elements of the second plurality of generally circular elements, and wherein the reduction of thickness percentage is greater than 5%.

16. A method, comprising:

determining a desired impression pattern for a metal strip;

determining a texture pattern for a work roll of a cold-rolling mill stand, wherein the texture pattern includes a plurality of elements and wherein determining the texture pattern includes calculating one or more dimensions of the plurality of elements such that the texture pattern imparts the desired impression pattern at a reduction of thickness percentage; and applying the texture pattern to the work roll, wherein the texture pattern of the work roll imparts the desired impression pattern on the metal strip when the metal strip is rolled by the work roll at the reduction of thickness percentage, wherein the desired impression pattern includes a first plurality of generally elliptical elements and a second plurality of generally elliptical elements, wherein an average size of the elements of the first plurality of generally elliptical elements is different than an average size of the elements of the second plurality of generally elliptical elements, and wherein the reduction of thickness percentage is greater than 5%.

17. A method, comprising:

determining a desired impression pattern for a metal strip;

determining a texture pattern for a work roll of a cold-rolling mill stand, wherein the texture pattern includes a plurality of elements and wherein determining the texture pattern includes calculating one or more dimensions of the plurality of elements such that the texture pattern imparts the desired impression pattern at a reduction of thickness percentage; and applying the texture pattern to the work roll, wherein the texture pattern of the work roll imparts the desired impression pattern on the metal strip when the metal strip is rolled by the work roll at the reduction of thickness percentage, wherein the desired impression pattern includes a plurality of generally circular elements and a plurality of generally elliptical elements, and wherein the reduction of thickness percentage is greater than 5%.

18. A method, comprising:

determining a desired impression pattern for a metal strip;

determining a texture pattern for a work roll of a cold-rolling mill stand, wherein the texture pattern includes a plurality of elements and wherein determining the texture pattern includes calculating one or more dimensions of the plurality of elements such that the texture pattern imparts the desired impression pattern at a reduction of thickness percentage; and applying the texture pattern to the work roll, wherein the texture pattern of the work roll imparts the desired impression pattern on the metal strip when the metal strip is rolled by the work roll at the reduction of thickness percentage, wherein the desired impression pattern includes a first plurality of generally circular elements and a second plurality of generally circular elements, wherein an average size of the elements of the first plurality of generally circular elements is different than an average size of the elements of the second plurality of generally circular elements, and wherein the reduction of thickness percentage is greater than 5%.

* * * * *